US007526228B2

(12) United States Patent
Shiraki

(10) Patent No.: US 7,526,228 B2
(45) Date of Patent: Apr. 28, 2009

(54) DEVELOPER CARTRIDGE, IMAGE CARRIER UNIT, AND IMAGE FORMING APPARATUS

(75) Inventor: Masatoshi Shiraki, Nisshin (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 237 days.

(21) Appl. No.: 11/683,776

(22) Filed: Mar. 8, 2007

(65) Prior Publication Data

US 2007/0223962 A1 Sep. 27, 2007

(30) Foreign Application Priority Data

Mar. 23, 2006 (JP) ..... 2006-081445

(51) Int. Cl.
*G03G 21/16* (2006.01)

(52) U.S. Cl. ..... 399/111; 399/113

(58) Field of Classification Search ..... 399/107, 399/110, 111, 113, 119, 120
See application file for complete search history.

(56) References Cited

U.S. PATENT DOCUMENTS 6,351,620 B1 * 2/2002 Miyabe et al. ..... 399/111
6,708,011 B2 3/2004 Nomura et al.
6,922,534 B2 * 7/2005 Goto et al. ..... 399/12
7,457,569 B2 * 11/2008 Kawai ..... 399/258

FOREIGN PATENT DOCUMENTS

JP 2003-015378 1/2003

* cited by examiner

*Primary Examiner*—Hoan H Tran
(74) *Attorney, Agent, or Firm*—Banner & Witcoff, Ltd.

(57) ABSTRACT

The present invention provides a developer cartridge detachably attachable to a casing of an image carrier unit, includes a developing roller and a first rotation body that rotates the developing roller by coupling to a second rotation body provided in an image forming apparatus body with the developer cartridge attached in the casing. The first rotation body is configured to advance and retract with respect to a side wall of the casing which extends along an attachment/detachment direction of the developer cartridge, and is normally urged in an advance direction. A downstream end portion of the first rotation body in the advance direction is arranged downstream in the advance direction from an upstream end of the side wall in the advance direction with the developer cartridge attached in the casing.

21 Claims, 16 Drawing Sheets

(a)

(b)

DEVELOPER CARTRIDGE, IMAGE CARRIER UNIT, AND IMAGE FORMING APPARATUS

CROSS REFERENCE TO RELATED APPLICATION

This application claims priority benefits on the basis of Japanese Patent Application No. 2006-81445 filed on Mar. 23, 2006, the disclosure of which is incorporated herein by reference.

BACKGROUND OF THE INVENTION

1. Field of the Invention

The present invention relates to an image forming apparatus such as a laser printer, and to an image carrier unit detachable to the image forming apparatus, and to a developer cartridge detachable to the image carrier unit.

2. Description of the Related Art

As for an image forming apparatus such as a laser printer, there have been known, for example, a color image forming apparatus having a plurality of developer cartridges for giving a toner onto a surface of a photosensitive drum in a photosensitive member cartridge, each of the developer cartridges being detachably arranged in juxtaposition (see, for example, Japanese Unexamined Patent Publication No. 2003-015378).

In the color image forming apparatus disclosed in Japanese Unexamined Patent Publication No. 2003-015378, guide grooves for receiving a developer cartridge in a fixed position corresponding to the photosensitive drum for each color, are arranged in the inner upper portion of each side plate of the frame of the photosensitive member cartridge, and fixed levers are pivotably attached thereto in order to retain each developer cartridge received along the guide grooves.

Each developer cartridge has a guide projection that is inserted into the guide groove from its upper open end.

In such color image forming apparatus, when the developer cartridge is attached to each corresponding photosensitive drum, the guide projections are inserted into the corresponding guide groove from above, and subsequently, the fixed levers are pivoted to retain the developer cartridge with the photosensitive member cartridge. On the other hand, when each developer cartridge is detached from the photosensitive member cartridge for replacement, the fixed levers for the corresponding developer cartridge to be removed, are pivoted in the reverse direction of attachment to be released, and the developer cartridge is withdrawn upwards along the guide groove.

SUMMARY OF THE INVENTION

The color image forming apparatus disclosed in Japanese Unexamined Patent Publication No. 2003-015378 requires pivoting of the fixed lever every attachment and detachment of the developer cartridge with respect to the photosensitive member cartridge. Moreover, a dedicated component, such as fixed lever, is provided to retain the developer cartridge with the photosensitive member cartridge, whereby the mechanism of the apparatus may become relatively complicated.

Therefore, it is an object of the present invention to provide a developer cartridge which can be easily and securely retained by an image carrier unit in a simple construction as well as excellent in operability, an image carrier unit to which the developer cartridge is detachably attached, and an image forming apparatus to which the developer cartridge and the image carrier unit are detachably attached.

An object of the present invention is to provide a developer cartridge detachably attachable to a casing of an image carrier unit detachably attachable to an image forming apparatus body, the developer cartridge including: a developing roller; and a first rotation body that rotates the developing roller by coupling to a second rotation body provided in the image forming apparatus body, in a state where the developer cartridge is attached in the casing, wherein the first rotation body is configured to advance and retract with respect to a side wall of the casing which extends along an attachment/detachment direction of the developer cartridge, and is normally urged in an advance direction, and a downstream end portion of the first rotation body in the advance direction is arranged downstream in the advance direction from an upstream end of the side wall in the advance direction, in the state where the developer cartridge is attached in the casing.

Another object of the present invention is to provide an image carrier unit detachably attachable to an image forming apparatus body, including: a casing; and a developer cartridge detachably attachable to the casing, wherein the developer cartridge includes a developing roller, and a first rotation body that rotates the developing roller by coupling to a second rotation body provided in the image forming apparatus body in a state where the developer cartridge is attached in the casing, the first rotation body is configured to advance and retract with respect to a side wall of the casing which extends along an attachment/detachment direction of the developer cartridge with respect to the casing, and is normally urged in an advance direction, a downstream end portion of the first rotation body in the advance direction is arranged downstream in the advance direction from an upstream end of the side wall in the advance direction, in the state where the developer cartridge is attached in the casing, the side wall is opposed to the first rotation body in the advance direction when the developer cartridge is attached to and detached from the casing, and the side wall is formed such that a portion thereof between upstream and downstream end portions in a attaching direction of the developer cartridge to the casing protrudes toward an upstream side in the advance direction from the upstream and downstream end portions.

Further another object of the present invention is to provide an image forming apparatus including: an image forming apparatus body, an image carrier unit detachably attachable to the image forming apparatus body, a scanning section for forming an electrostatic latent image in the image carrier unit; and a fixing unit for fixing to a recording medium a developer image formed by developing the electrostatic latent image in the image carrier unit, wherein the image carrier unit includes a casing, and a developer cartridge detachably attachable to the casing, the developer cartridge includes a developing roller, and a first rotation body that rotates the developing roller by coupling to a second rotation body provided in the image forming apparatus body, in a state where the developer cartridge is attached in the casing, the first rotation body is configured to advance and retract with respect to a side wall of the casing which extends along an attachment/detachment direction of the developer cartridge with respect to the casing, and is normally urged in an advance direction, a downstream end portion of the first rotation body in the advance direction is arranged downstream in the advance direction from an upstream end of the side wall in the advance direction, in the state where the developer cartridge is attached in the casing, the side wall is opposed to the first rotation body in the advance direction when the developer cartridge is attached to and detached from the casing, and the side wall is formed such that a portion thereof between upstream and downstream end portions in the attaching direction of the developer cartridge to the casing protrudes toward an upstream side in the advance direction from the upstream and downstream end portions.

DETAILED DESCRIPTION OF PREFERRED EMBODIMENTS

Embodiments of the present invention will hereinafter be described with reference to the attached drawings.

First Embodiment

1. General Structure of Color Laser Printer

Figure 1:
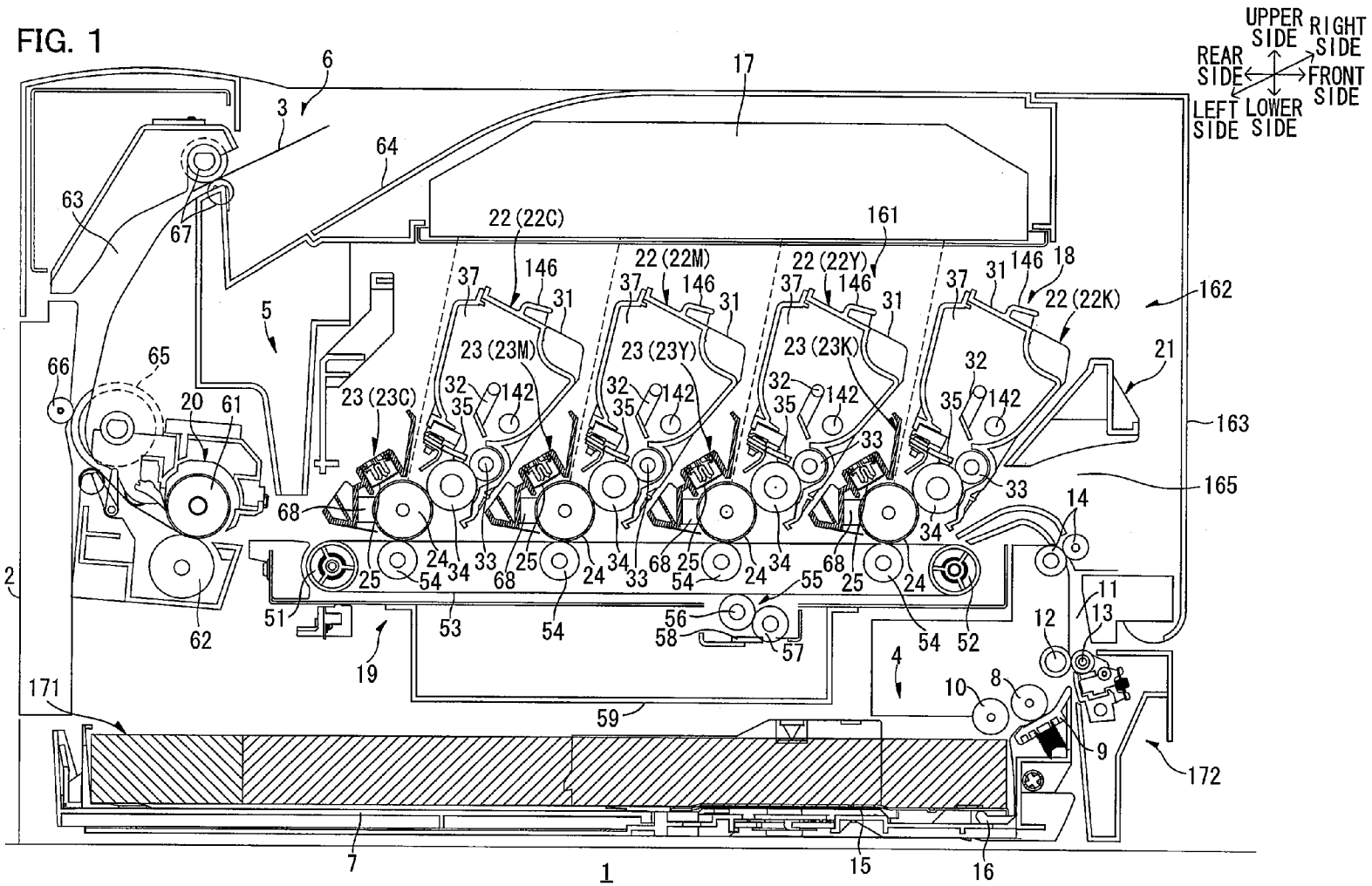
FIG. 1 is a side sectional view of the major portion of a color laser printer serving as an image forming apparatus according to one embodiment of the present invention.
Figure 2:
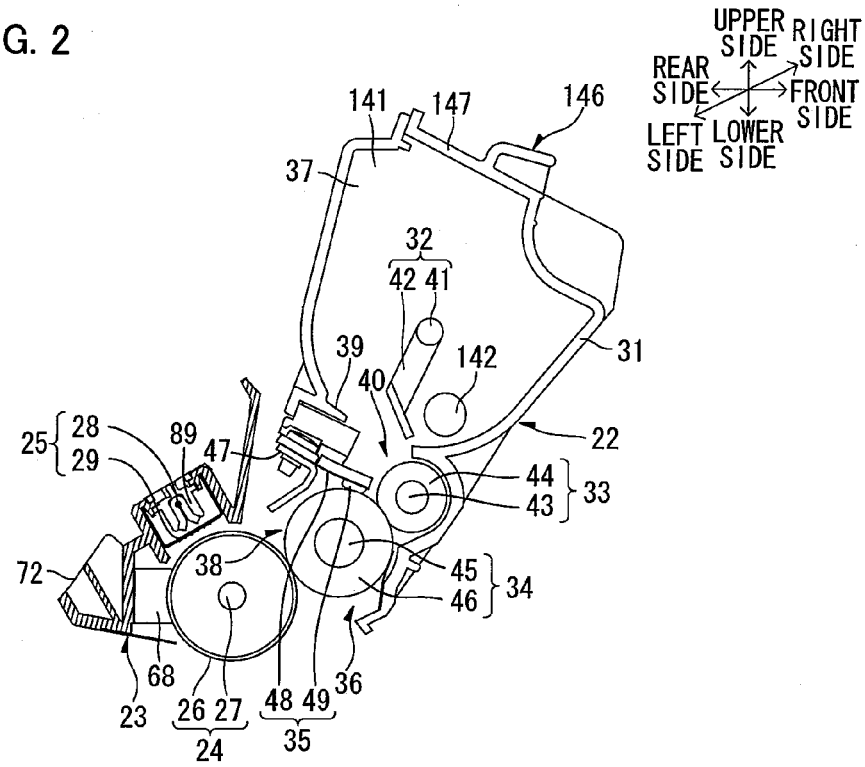
FIG. 2 is a side sectional view of the major portion of a drum subunit attached with a developer cartridge of the color laser printer shown in FIG. 1.
Figure 3:
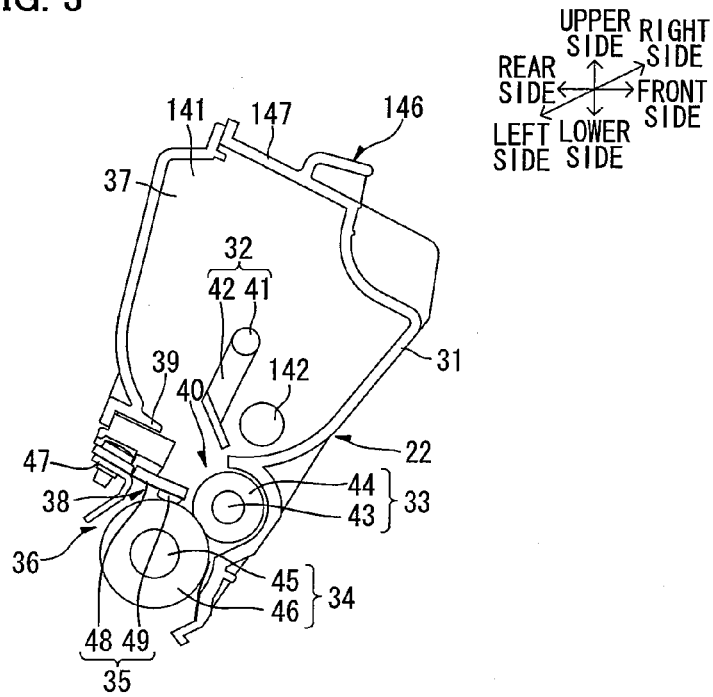
FIG. 3 is a side sectional view of the major portion of the developer cartridge shown in FIG. 2.

FIG. 1 is a side sectional view of the major portion of a color laser printer serving as an image forming apparatus according to one embodiment of the present invention; FIG. 2 is a side sectional view of the major portion of a drum subunit attached with a developer cartridge of the color laser printer shown in FIG. 1; and FIG. 3 is a side sectional view of the major portion of the developer cartridge shown in FIG. 2.

As shown in FIG. 1, the color laser printer 1 is of a horizontal-tandem type, in which a plurality of drum subunits 23 (described later) serving as an image carrier unit are horizontally arranged in juxtaposition. The color laser printer 1 includes a sheet feeding section 4 for feeding a sheet 3 as a recording medium, an image forming section 5 for forming images on the sheet 3 fed by the sheet feeding section 4, and a sheet ejecting section 6 for ejecting the sheet 3 with an image formed thereon, in a main body casing 2 serving as an image forming apparatus body.

In the following description, the right side of the paper plane of FIG. 1 (the side provided with a drum mounting port 162 in the main body casing 2) will be referred to as the front side, while the left side thereof will be referred to as the rear side. Further, the near side in the paper thickness direction of the FIG. 1 will be referred to as the left side, while the far side therein will be referred to as the right side. The left and right direction may be called as the width direction.

The directions described below will be referred to as the directions when a drum unit 21 and a developer cartridge 22 each described later are attached in the main body casing 2, unless otherwise noted.

(1) Sheet Feeding Section

The sheet feeding section 4 in the bottom section of the main body casing 2, is anteroposteriorly slidably attached in or detached from a tray accommodation section 171 described later from the front side. The sheet feeding section 4 includes a sheet feeding tray 7 that accommodates sheets 3, a separation roller 8 and a separation pad 9, and a sheet feeding roller 10.

In the sheet feeding section 4, a sheet feeding transport path 11 for sheets 3, is formed generally in a U-shape as viewed in side and adjacent to the separation roller 8 and a transport belt 53 described later.

A sheet dust removing roller 12 and a pinch roller 13, and a pair of resist rollers 14 are provided midway in the sheet feeding transport path 11.

A sheet pressing plate 15 is provided inside the sheet feeding tray 7. This sheet pressing plate 15 is swingably supported, thereby freely moving between a placement position along a bottom plate of the sheet feeding tray 7 and an inclined feeding position.

A lever 16 is swingably provided in the sheet feeding tray 7. By swinging the lever 16, the sheet pressing plate 15 is positioned in a sheet feeding position.

When the sheet pressing plate 15 is positioned in the sheet feeding position, an uppermost sheet 3 thereon is fed toward between the separation roller 8 and the separation pad 9 by rotation of the sheet feeding roller 10.

When the sheet feeding tray 7 is detached from the main body casing 2, the sheet pressing plate 15 is positioned in the placement position, which allows the sheets 3 to be placed on the sheet pressing plate 15 in a stacked manner.

The sheets 3 thus fed are separated and transported one by one. Then, each transported sheet 3 passes between the sheet dust removing roller 12 and the pinch roller 13, so that sheet dust is removed from the sheet 3. Thereafter, the sheet 3 is transported along the sheet feeding transport path 11 toward the resist rollers 14.

After the registration of the sheet 3, the resist rollers 14 transport the sheet 3 onto the transport belt 53.

(2) Image Forming Section

The image forming section 5 includes a scanning section 17, a processing section 18, a transferring section 19, and a fixing section 20 serving as a fixing unit.

(2-1) Scanning Section

One scanning section 17 is provided in the upper section of the main body casing 2 to scan laser beams emitted from a laser emitting section (not shown) based on image data corresponding to respective colors, with a polygon mirror. Then, the scanning section 17 allows the laser beams thus scanned to pass through or to be reflected by a plurality of lens and reflecting mirrors, and then, emits the laser beams to the corresponding photosensitive drums 24 corresponding to respective colors.

(2-2) Processing Section

The processing section 18 is arranged below the scanning section 17, and above the sheet feeding section 4. As will be described in greater detail later, the processing section 18 includes one drum unit 21 and four developer cartridges 22 corresponding to respective colors.

(2-2-1) Drum Unit

The drum unit 21 is anteroposteriorly detachably attached to a drum accommodation section 161 described later in the main body casing 2 from the front side, as will be described later in further detail. The drum unit 21 includes four drum subunits 23 corresponding to respective colors. Specifically, the drum subunit 23 includes a yellow, magenta, cyan, and black drum subunits 23Y, 23M, 23C, and 23K.

The drum subunits 23 are arranged in juxtaposition with each being anteroposteriorly spaced apart from one another. Specifically, the black drum subunit 23K, the yellow drum subunit 23Y, the magenta drum subunit 23M, and the cyan drum subunit 23C are arranged in this order, from the front side to the rear side.

Each drum subunit 23 includes a left side frame 70, a right side frame 71, and a center frame 72 serving as a casing, as described later (see FIG. 8).

As shown in FIG. 2, each drum subunit 23 retains a photosensitive drum 24, a scorotron charger 25, and a cleaning brush 68.

The photosensitive drum 24 has a cylindrical shape arranged in the width direction, and includes a drum body 26 formed of a positive charging photosensitive layer with an outermost surface layer of polycarbonate, and a drum shaft 27 arranged along the axial direction of the drum body 26.

A rotation support member 30 (see FIG. 9) is relatively unrotatably fitted to each of both axial end portions of the drum body 26, and is relatively rotatably supported around the drum shaft 27. Thus, the drum body 26 is rotatably supported with respect to the drum shaft 27. During an image forming operation, a driving force from a motor (not shown) provided in the main body casing 2, is transmitted to the photosensitive drum 24, so that the photosensitive drum 24 rotates.

The scorotron charger 25 is arranged obliquely rearward above the photosensitive drum 24 so as to be spaced in opposed relation thereto, while being retained by the center frame 72 described later. The scorotron charger 25 includes a discharge wire 28 spaced in opposed relation to the photosensitive drum 24, and a grid 29 provided between the discharge wire 28 and the photosensitive drum 24.

A wire electrode 80 (see FIG. 8) described later is connected to the discharge wire 28, and a grid electrode 81 (see FIG. 8) described later is connected to the grid 29.

In the scorotron charger 25, during an image forming operation, a high voltage is applied to the discharge wire 28 via the wire electrode 80 from a high-voltage circuit board (not shown) provided in the main body casing 2, so that corona discharge occurs in the discharge wire 28. Further, in the scorotron charger 25, a high voltage is applied to the grid 29 via the grid electrode 81 from the high-voltage circuit board (not shown) provided in the main body casing 2, so that the surface of the photosensitive drum 24 is charged with a uniform positive polarity while the amount of charge supplied to the photosensitive drum 24 is controlled.

The cleaning brush 68 is arranged rearward of the photosensitive drum 24 so as to be oppositely in contact therewith, and is retained by the center frame 72 described later. During an image forming operation, a cleaning bias is applied to the cleaning brush 68 via a cleaning electrode 83 (see FIG. 8) described later from the high-voltage circuit board (not shown) provided in the main body casing 2.

(2-2-2) Developer Cartridge

As shown in FIG. 1, the developer cartridges 22 are individually detachably provided in the drum subunits 23 for the respective corresponding colors. Specifically, the four developer cartridges 22 include yellow, magenta, cyan, and black developer cartridges 22Y, 22M, 22C, and 22K that are detachably attached in a yellow, magenta, cyan, and black drum subunits 23Y, 23M, 23C, and 23K, respectively.

As shown in FIG. 3, each of the developer cartridges 22 includes a developer frame 31, and an agitator 32, a feed roller 33, a developing roller 34, and a layer-thickness regulating blade 35 that are provided in the developer frame 31.

The developer frame 31 is formed in a box-like shape with a developer opening 36 opened at the lower end thereof (see FIG. 5), and is divided into a toner accommodation chamber 37 and a developing chamber 38 by a partition wall 39 formed midway in the up and down direction. The partition wall 39 has a communication port 40 that allows the toner accommodation chamber 37 to communicate with the developing chamber 38.

The toner accommodation chamber 37 accommodates a toner of each color. More specifically, the toner accommodation chambers 37 accommodates the yellow, magenta, cyan, and black toners in the yellow, magenta, cyan, and black developer cartridges 22Y, 22M, 22C, and 22K, respectively.

A positively-charging, non-magnetic, single-component polymerized toner is used as the toner of each color. The coloring agents of yellow, magenta, cyan, and black described above are mixed corresponding to each color.

The toner accommodation chamber 37 is provided with windows 142 for detecting the residual amount of the toner accommodated therein. The windows 142 are embedded in both side walls 141 of the developer frame 31, respectively, and are arranged in opposed relation with the toner accommodation chamber 37 being interposed therebetween.

The agitator 32 is provided in the toner accommodation chamber 37. The agitator 32 includes an agitator rotating shaft 41 that is rotatably supported on the both side walls 141 of the developer frame 31, and an agitating member 42 that is axially provided across the agitator rotating shaft 41 while extending outward in the radial direction from the rotating shaft 41. During an image forming operation, a driving force from a motor (not shown) provided in the main body casing 2 is transmitted to the agitator rotating shaft 41 via an input gear 120 (see FIG. 5) serving as a first rotation body, so that the agitating member 42 circularly moves in the toner accommodation chamber 37.

The feed roller 33 is provided below the communication port 40 in the developing chamber 38. The feed roller 33 includes a metal feed roller shaft 43 that is rotatably supported on the both side walls 141 of the developer frame 31, and a sponge roller 44 that is made of electrically-conductive sponge for covering the feed roller shaft 43. During an image forming operation, a driving force from a motor (not shown) provided in the main body casing 2 is transmitted to the feed roller shaft 43 via the input gear 120 (see FIG. 5), so that the feed roller 33 is rotated.

The developing roller 34 is provided obliquely rearward below the feed roller 33 in the developing chamber 38. The developing roller 34 includes a metal developing roller shaft 45 that is rotatably supported on the both side walls 141 of the developer frame 31, and a rubber roller 46 that is made of electrically-conductive rubber for covering the developing roller shaft 45.

More specifically, the rubber roller 46 has a two-layer construction of a rubber roller layer and a coating layer that is coated on a surface thereof. A current supply coil 155 (see FIG. 8) of a developing roller electrode 82 described later is connected to the developing roller shaft 45, with the developer cartridge 22 attached in the drum subunit 23.

The developing roller 34 is arranged against the feed roller 33 so that the rubber roller 46 and the sponge roller 44 are in pressure contact with each other. The developing roller 34 is also arranged as being exposed downward from the developer opening 36 of the developing chamber 38.

In the developing roller 34, during an image forming operation, a driving force from a motor (not shown) provided in the main body casing 2 is transmitted to the developing roller shaft 45 via the input gear 120 (see FIG. 5), so that the developing roller 34 is rotated. A developing bias is applied to the developing roller shaft 45 via the developing roller electrode 82 (see FIG. 8) and the current supply coil 155 (see FIG. 8) from the high-voltage circuit board (not shown) provided in the main body casing 2.

The layer-thickness regulating blade 35 is provided in pressure contact with the developing roller 34 from above in the developing chamber 38. The layer-thickness regulating blade 35 includes a blade 48 including a metal leaf-spring member, and a pressing member 49 having a semicircular section that are made of insulating or electrically-conductive rubber and are provided in the distal end of the blade 48.

The proximal edge of the blade 48 is fixed to the partition wall 39 by a fixing member 47. An elastic force of the blade 48 brings the pressing member 49 into pressure contact with the rubber roller 46 of the developing roller 34 from above.

(2-2-3) Developing Operation in a Processing Section

In each developer cartridge 22, a toner of each color accommodated in the corresponding toner accommodation chamber 37 moves to the communication port 40 by its own weight, and is then released from the communication port 40 to the developing chamber 38 while being agitated by the agitator 32.

The toner thus released is then supplied to the feed roller 33. Rotation of the feed roller 33 supplies the toner thus supplied to the developing roller 34. At this time, the toner is triboelectrically charged with a positive polarity between the feed roller 33 and the developing roller 34 to which a developing bias is applied.

Then, the toner thus supplied to the developing roller 34 enters between the pressing member 49 of the layer-thickness regulating blade 35 and the rubber roller 46 of the developing roller 34 along with the rotation of the developing roller 34. Then, the toner forms a thin layer having a certain thickness, which is carried on the surface of the rubber roller 46.

On the other hand, as shown in FIG. 2, in the drum subunit 23 corresponding to the developer cartridge 22, the scorotron charger 25 generates corona discharge to uniformly positively charge the surface of the photosensitive drum 24.

Along with the rotation of the photosensitive drum 24, the surface thereof is uniformly positively charged by the scorotron charger 25, followed by exposure by high-speed scanning of the laser beam from the scanning section 17. Thus, an electrostatic latent image corresponding to an image to be formed on a sheet 3 is formed thereon.

As the photosensitive drum 24 further rotates, the developing roller 34 subsequently rotates to come in contact with the photosensitive drum 24 in opposed relation. At this time, the positively charged toner carried on the surface of the developing roller 34 is supplied to the electrostatic latent image (exposed portion having a lower potential due to the exposure to the laser beams) formed on the surface of the photosensitive drum 24. Thus, the toner transforms the electrostatic latent image on the photosensitive drum 24 into a visible image, whereby the photosensitive drum 24 carries on its surface a toner image by reversal developing corresponding to each color.

A toner remaining on the photosensitive drum 24 after the transfer operation is recovered by the developing roller 34. Further, sheet dust deposited on the photosensitive drum 24 from the sheet 3 after the transfer operation is recovered by the cleaning brush 68.

(2-3) Transferring Section

As shown in FIG. 1, the transferring section 19 is anteroposteriorly arranged above the sheet feeding section 4 and below the processing section 18 in the main body casing 2. The transferring section 19 includes a driving roller 51, a driven roller 52, a transport belt 53, a transfer roller 54, and a cleaning section 55.

The driving roller 51 and the driven roller 52 are anteroposteriorly spaced in opposed relation to each other. The driving roller 51 is arranged on the rear side of the cyan drum subunit 23C, and the driven roller 52 is arranged on the front side of the black drum subunit 23K.

The transport belt 53 is an endless belt formed of electrically-conductive resin film. The transport belt 53 is wound between the driving roller 51 and the driven roller 52.

During an image forming operation, a driving force from a motor (not shown) provided in the main body casing 2 is transmitted to the driving roller 51, so that the driving roller 51 rotates. Then, the transport belt 53 circumferentially moves between the driving roller 51 and the driven rollers 52 so as to rotate in the same direction of the rotation of the photosensitive drums 24 at transfer positions where the belt is oppositely in contact with the photosensitive drums 24 in the respective drum subunits 23, and the driven roller 52 is driven thereby.

The transfer rollers 54 are provided in the transport belt 53 wound between the driving roller 51 and the driven roller 52 so as to be opposed to the respective photosensitive drums 24 with the transport belt 53 interposed therebetween. Each transfer roller 54 has a metal roller shaft covered with a rubber roller made of electrically-conductive rubber. Each of the transfer rollers 54 is provided oppositely in contact with the transport belt 53 at the transfer positions so as to rotate in the same direction of circumferential move of the transport belt 53. During an image forming operation, a transfer bias is applied to the transfer rollers 54 from the high-voltage circuit board (not shown) provided in the main body casing 2.

The cleaning section 55 is arranged below the transport belt 53 that is wound between the driving roller 51 and the driven roller 52, and includes a primary cleaning roller 56, a secondary cleaning roller 57, a scraping blade 58, and a toner retention member 59.

The sheet 3 fed from the sheet feeding section 4 is transported toward the rear side from the front side by the transport belt 53 that is circumferentially moved by the driving of the driving roller 51 and the following movement of the driven roller 52 so that the sheet 3 sequentially passes through the transfer positions of the respective drum subunits 23. During the transportation, color toner images carried on the photosensitive drums 24 in the respective drum subunits 23 are sequentially transferred onto the sheet 3, whereby a color image is formed on the sheet 3.

Specifically, for example, a black toner image carried on the surface of the photosensitive drum 24 of the black drum subunit 23K, is transferred onto a sheet 3, and subsequently, a yellow toner image carried on the surface of the photosensitive drum 24 of the yellow drum subunit 23Y, is transferred and overlapped onto the sheet 3 where the black toner image has already been transferred. Then, in the same manner as above, a magenta toner image carried on the surface of the photosensitive drum 24 of the magenta drum subunit 23M, and a cyan toner image carried on the surface of the photosensitive drum 24 of the cyan drum subunit 23C, are sequentially transferred and overlapped thereonto, whereby a color image is formed on the sheet 3.

On the other hand, in the transfer operation described above, the toner adhered to the surface of the transport belt 53 is in the cleaning section 55 first transferred onto the primary cleaning roller 56 by a primary cleaning bias, and then transferred onto the secondary cleaning roller 57 by a secondary cleaning bias. Thereafter, the toner thus transferred onto the secondary cleaning roller 57 is scraped off by the scraping blade 58 to fall from the secondary cleaning roller 57, which in turn is stored in the toner retention member 59.

(2-4) Fixing Section

The fixing section 20 is arranged on the rear side of the cyan drum subunit 23C in the main body casing 2 so as to be anteroposteriorly opposed to the transfer positions where the photosensitive drums 24 contact the transport belt 53. The fixing section 20 includes a heating roller 61 and a pressure roller 62. The color image transferred onto the sheet 3, is subsequently transported to the fixing section 20, and is thermally fixed onto the sheet 3 while the sheet 3 passes between the heating roller 61 and the pressure roller 62.

(3) Sheet Ejecting Section

The sheet ejecting section 6 is provided with a sheet ejection tray 64. In the sheet ejecting section 6, a sheet ejecting transport path 63 for sheets 3 is adjacent to the fixing section 20 and the sheet ejection tray 64, and is formed generally in a U-shape as viewed in side.

The sheet ejecting transport path 63 is provided midway with a transport roller 65 and a pinch roller 66, and at its downstream end with one pair of sheet ejecting rollers 67.

The sheet 3 transported from the fixing section 20 is transported along the sheet ejecting transport path 63 by the transport roller 65 and the pinch roller 66, and is ejected onto the sheet ejection tray 64 by the sheet ejecting roller 67.

2. Drum Unit

Figure 4:
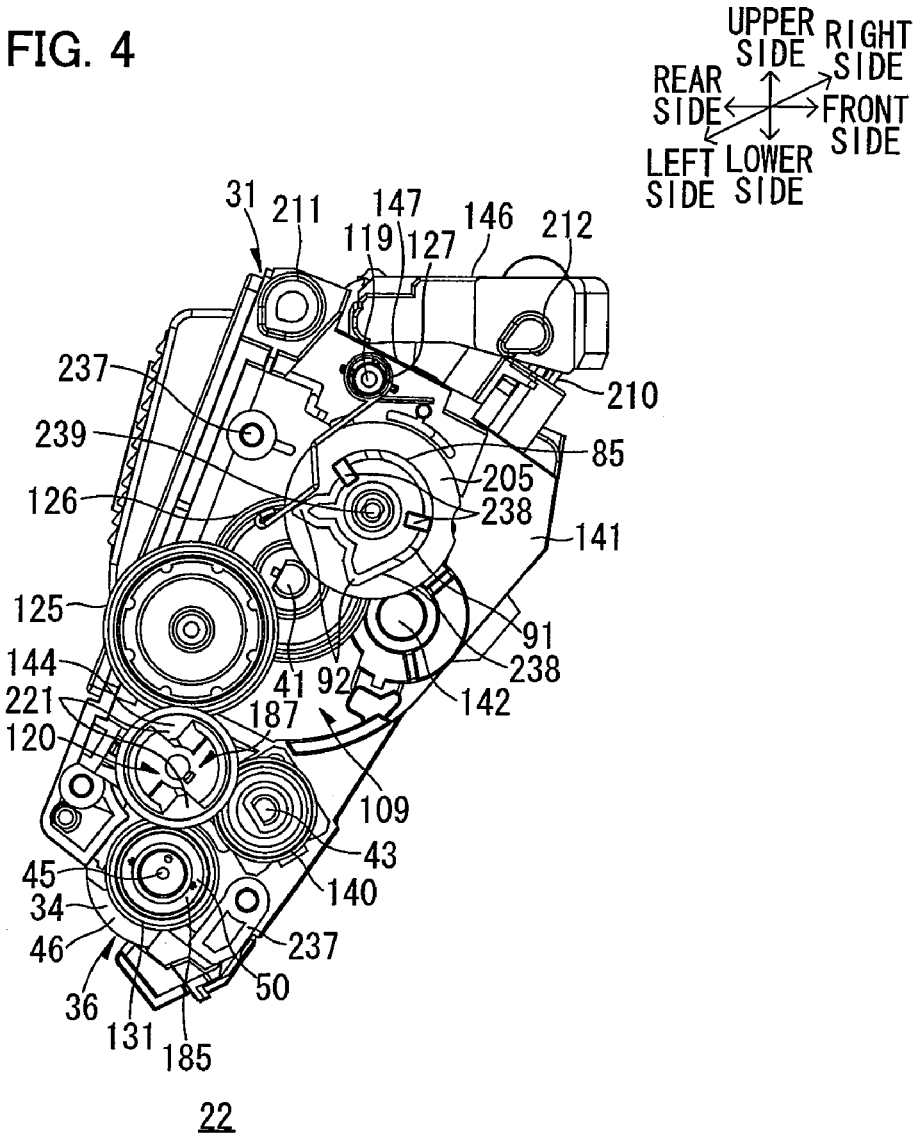
FIG. 4 is a left side view of the developer cartridge in FIG. 3, showing a mode where a gear cover has been removed.
Figure 5:
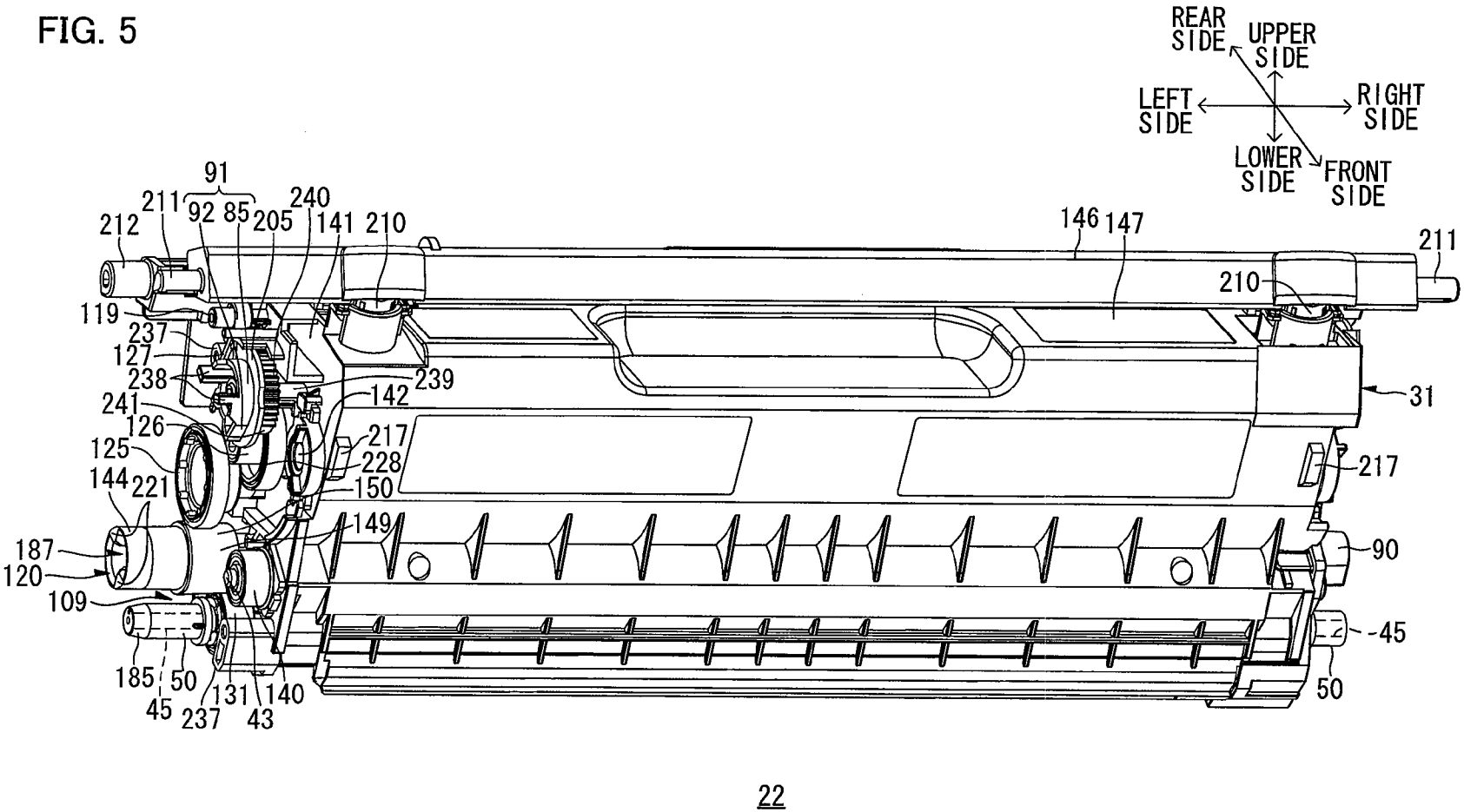
FIG. 5 is a left side perspective view of the developer cartridge in FIG. 4.
Figure 6:
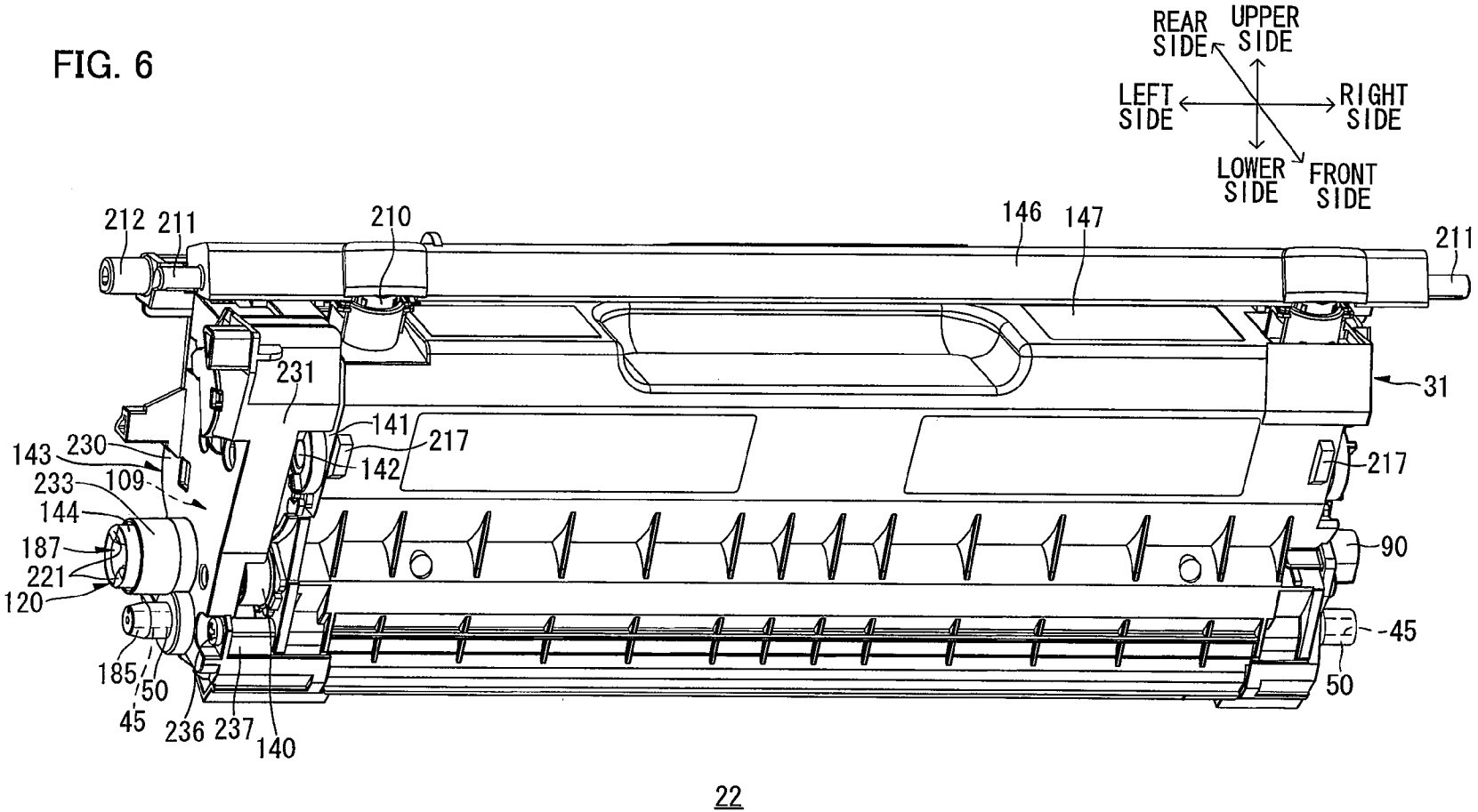
FIG. 6 shows a mode where the gear cover has been attached to the developer cartridge shown in FIG. 5 and an input gear is in an advance position.
Figure 7:
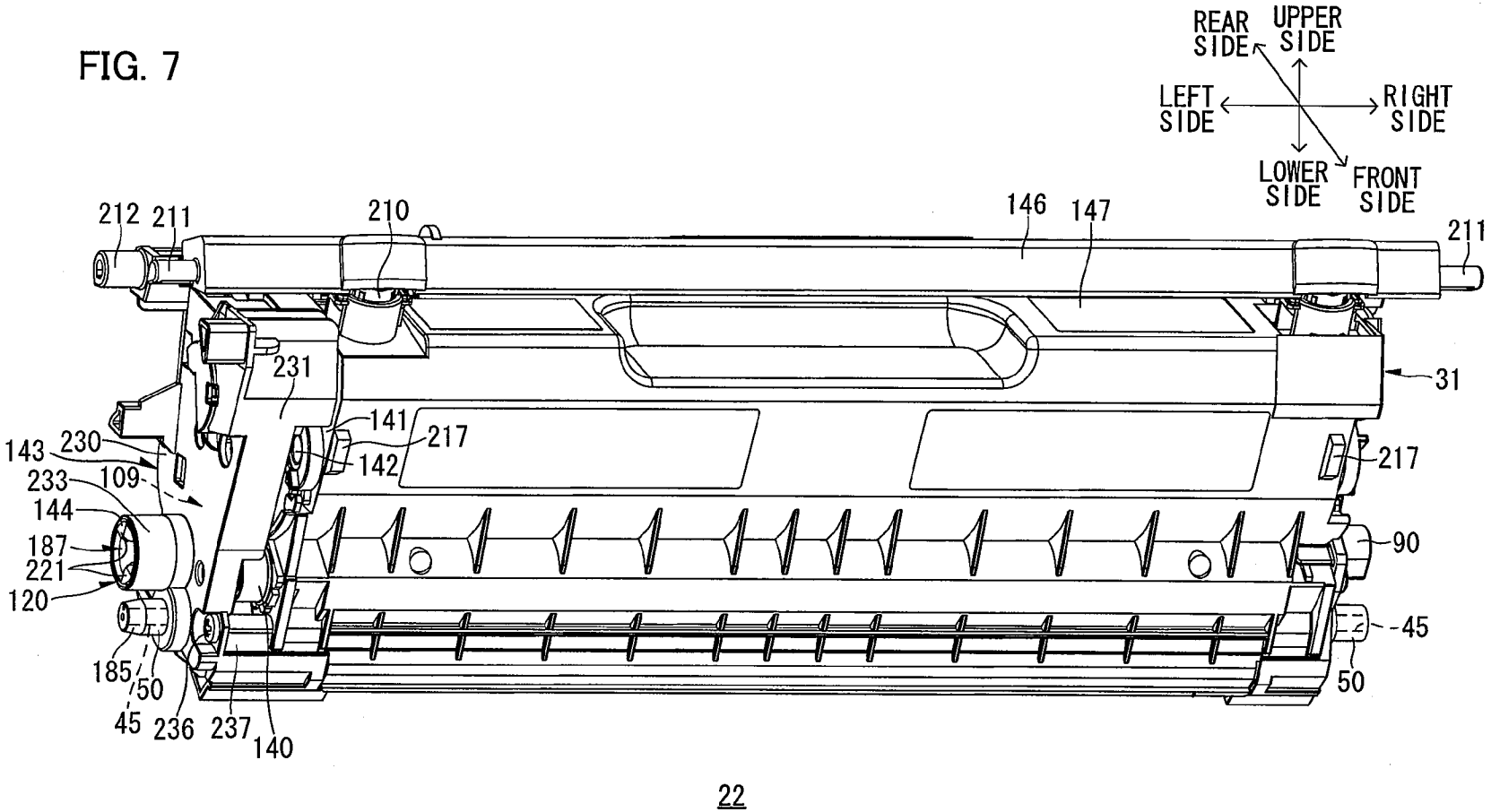
FIG. 7 shows a mode where the input gear is in a retract position in FIG. 6.

FIG. 4 is a left side view of the developer cartridge in FIG. 3, showing a mode where a gear cover has been removed; FIG. 5 is a left side perspective view of the developer cartridge in FIG. 4; FIG. 6 shows a mode where the gear cover has been attached to the developer cartridge shown in FIG. 5 and an input gear is in an advance position; and FIG. 7 shows a mode where the input gear is in a retract position in FIG. 6.

Figure 8:
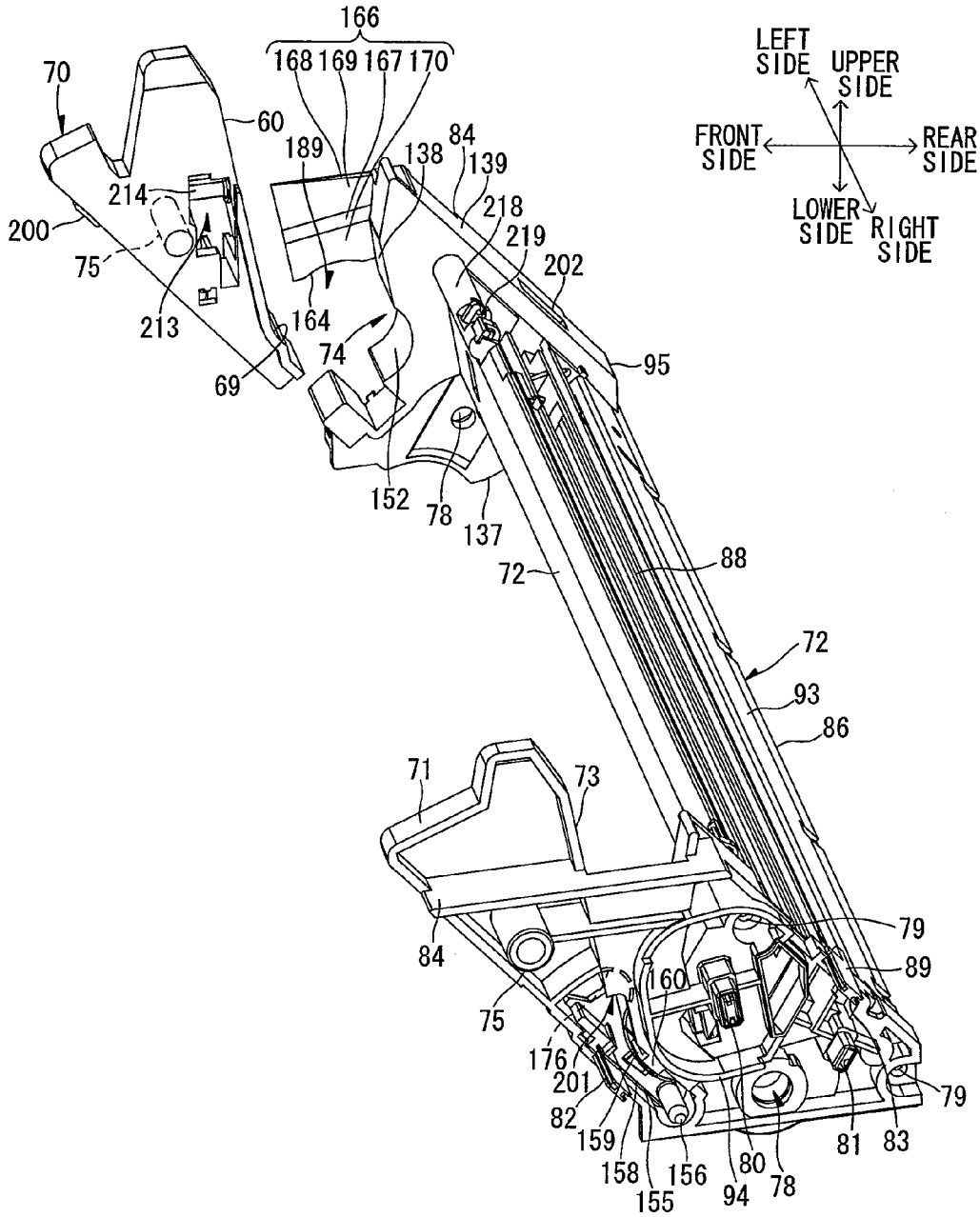
FIG. 8 is a right side perspective view of a drum subunit.
Figure 9:
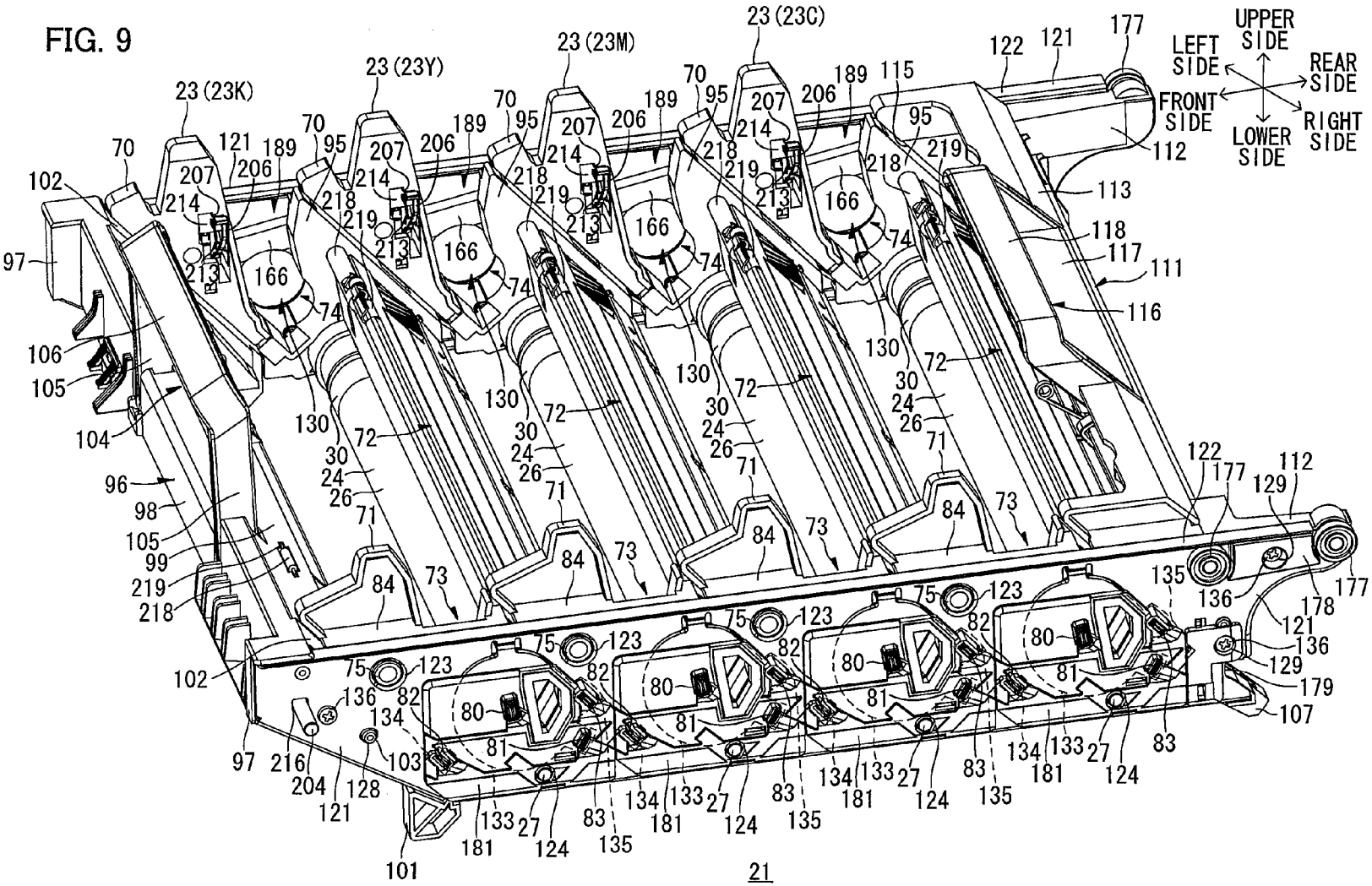
FIG. 9 is a right side perspective view showing a state where one pair of side plates has been assembled, with a front beam, four drum subunits, and a rear beam provided in parallel.
Figure 10:
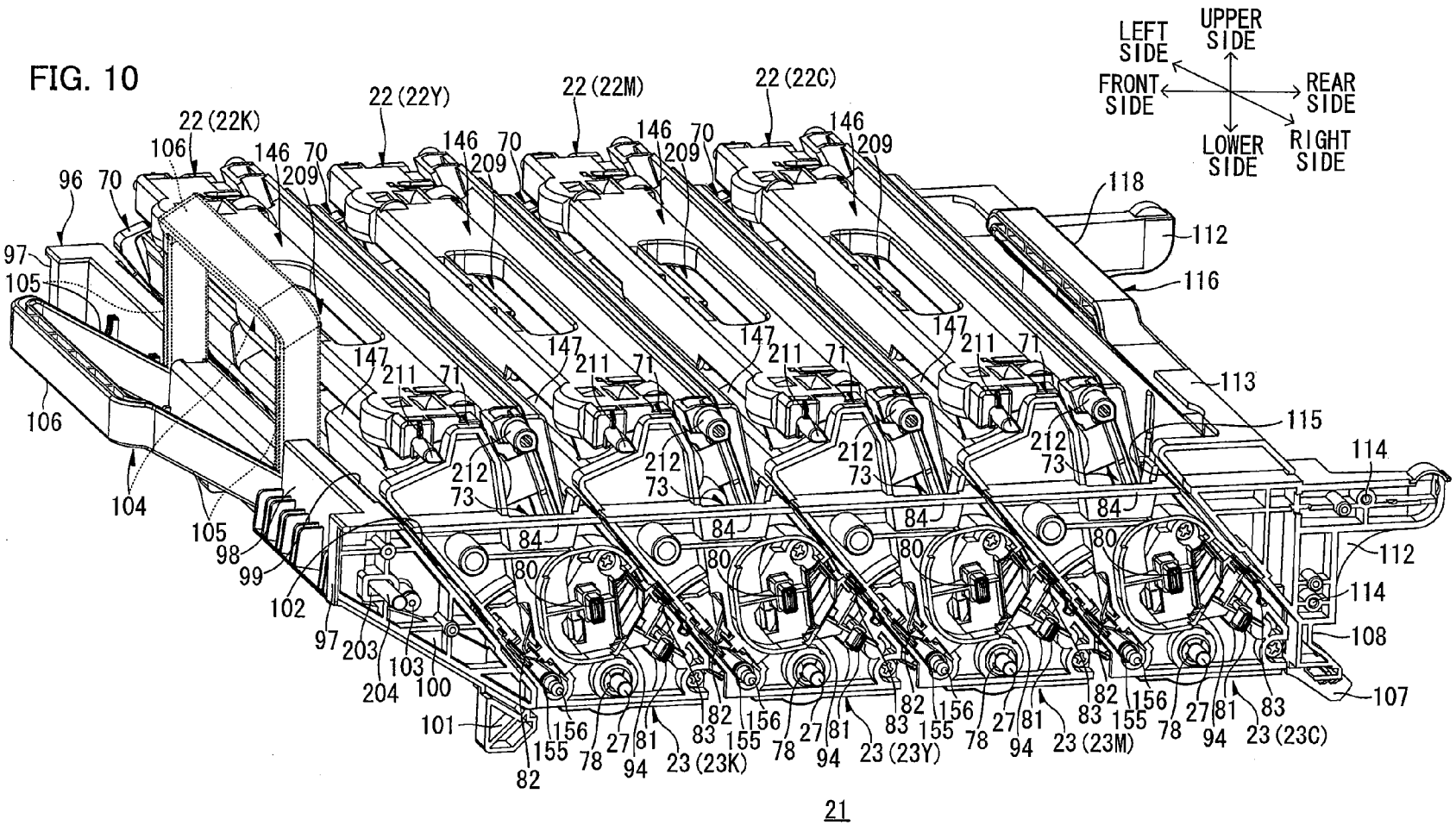
FIG. 10 is a right side perspective view of a drum unit (with a developer cartridge attached) showing a mode where one pair of side plates has been removed.

FIG. 8 is a right side perspective view of a drum subunit; and FIG. 9 is a right side perspective view showing a state where a pair of side plates has been assembled, with a front beam, four drum subunits, and a rear beam disposed in parallel. FIG. 10 is a right side perspective view of a drum unit (with a developer cartridge attached) showing a mode where a pair of side plates has been removed.

Figure 11:
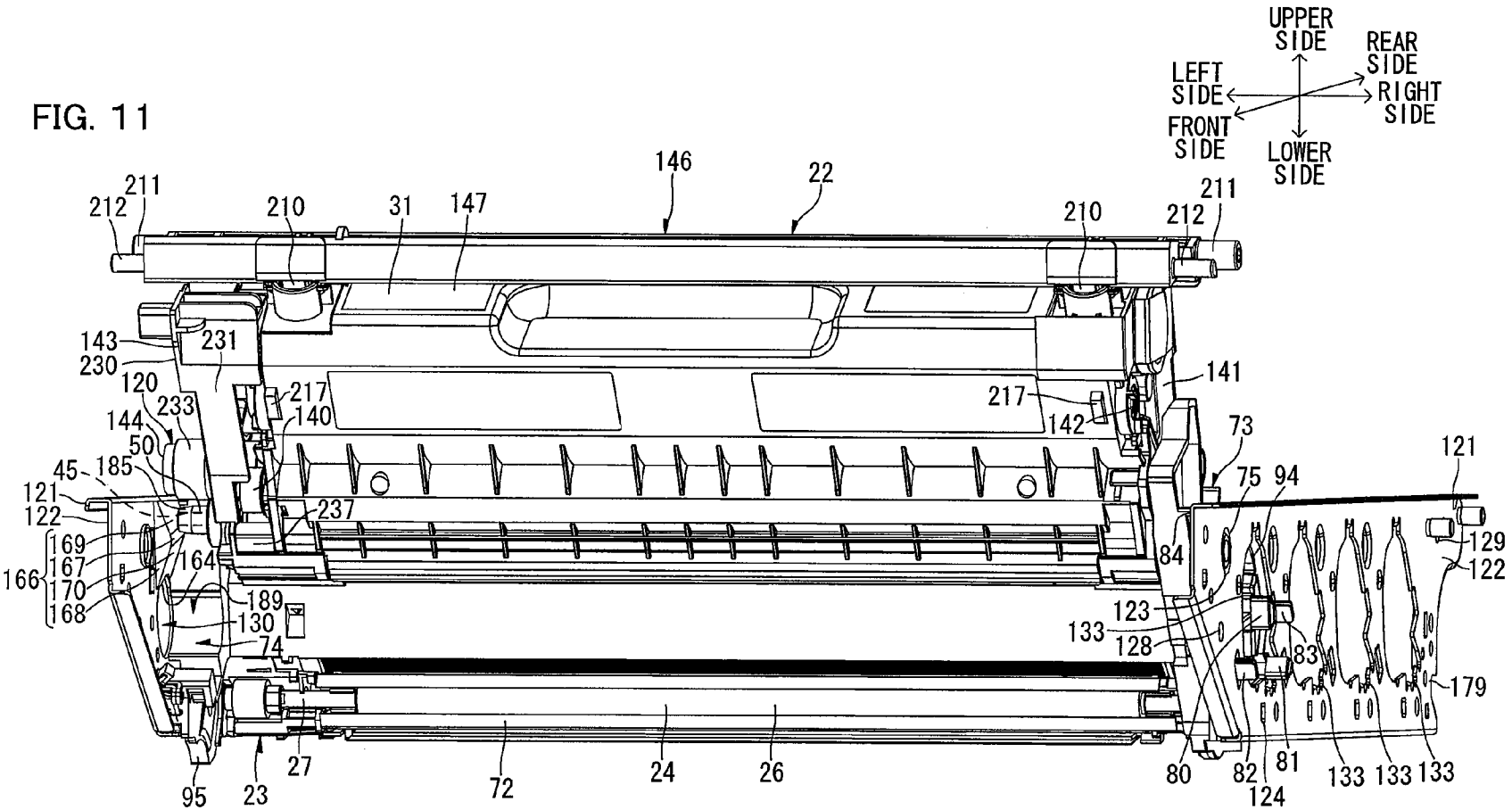
FIG. 11 is a right side perspective view showing a state where a developer cartridge is attached to one drum subunit (a left side frame is not shown) that has been assembled to one pair of side plates, showing the developer cartridge at the start of attaching.
Figure 12:
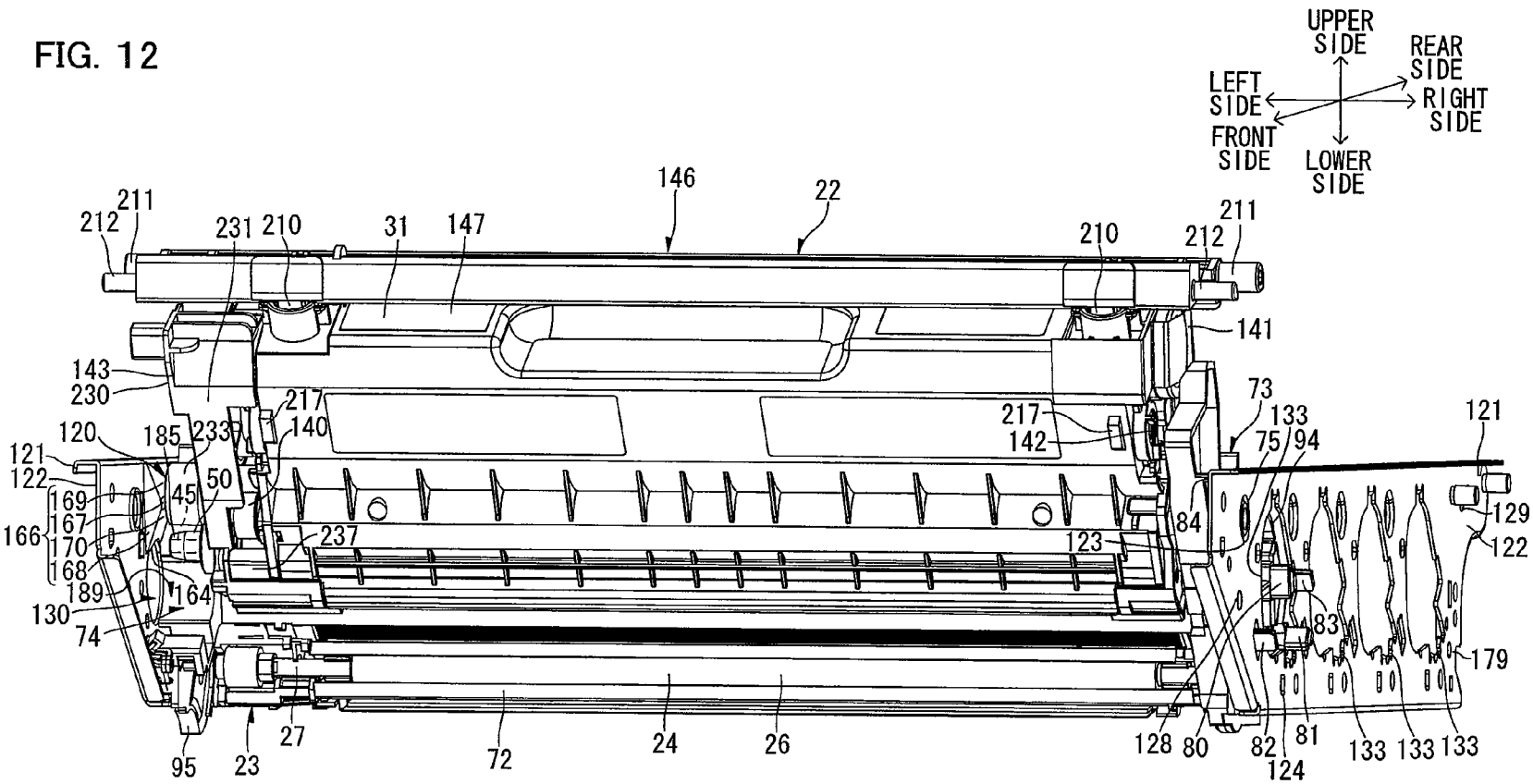
FIG. 12 shows the developer cartridge in FIG. 11 midway through attaching.
Figure 13:
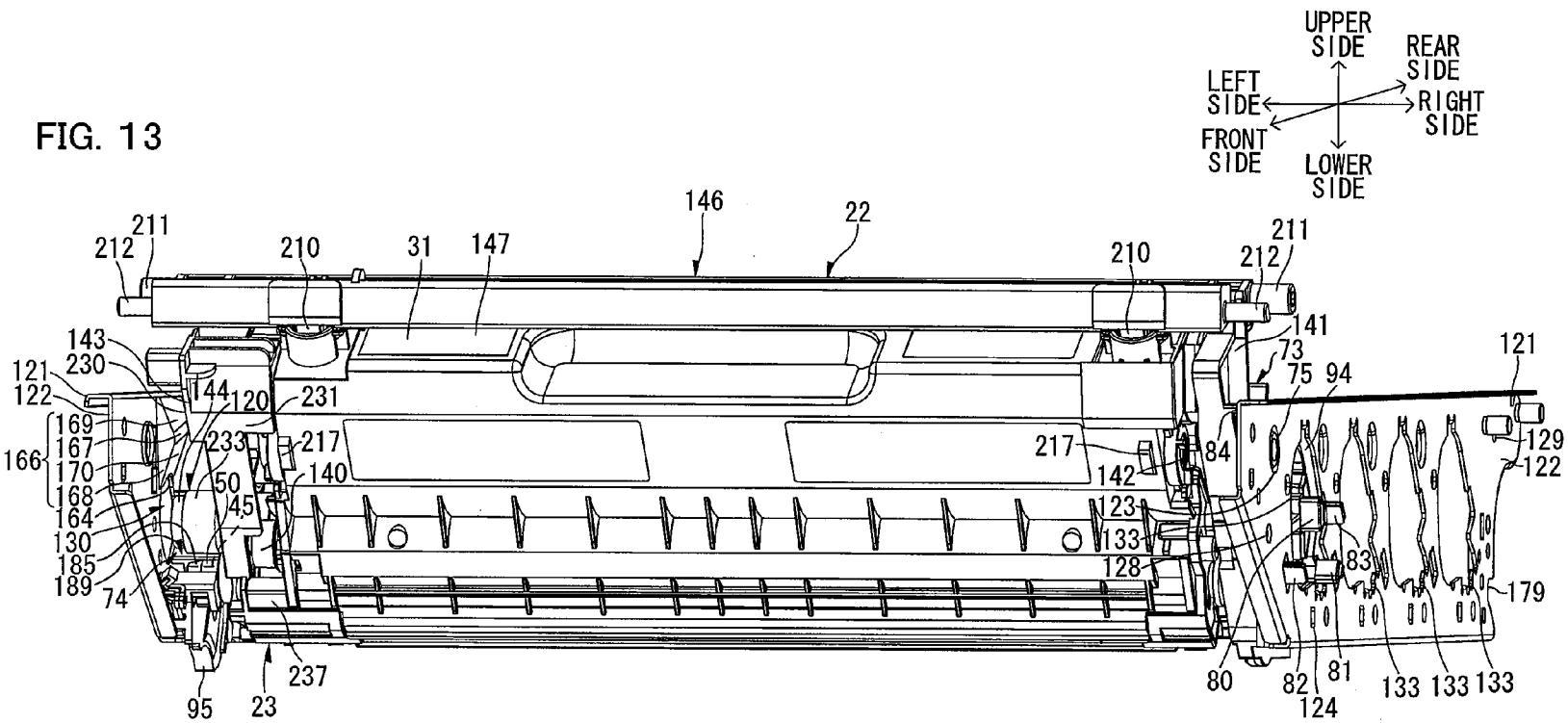
FIG. 13 shows the developer cartridge in FIG. 11 at the completion of attaching.

FIG. 11 is a right side perspective view showing a state where a developer cartridge is attached to one drum subunit (a left side frame is not shown) that has been assembled to a pair of side plates, showing the developer cartridge at the start of attaching; FIG. 12 shows the developer cartridge midway through the attaching; and FIG. 13 shows the developer cartridge at the completion of the attaching.

Figure 14:
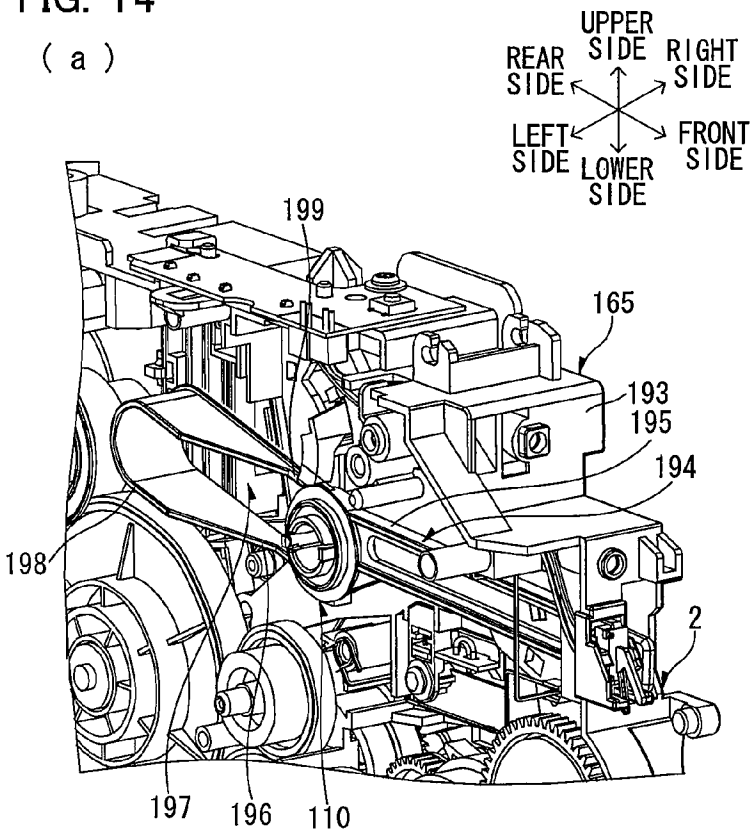
FIGS. 14(*a*) and 14(*b*) are left side perspective views of the periphery of a driving gear and an arm for explaining abutment states of the driving gear against the arm.
Figure 14:
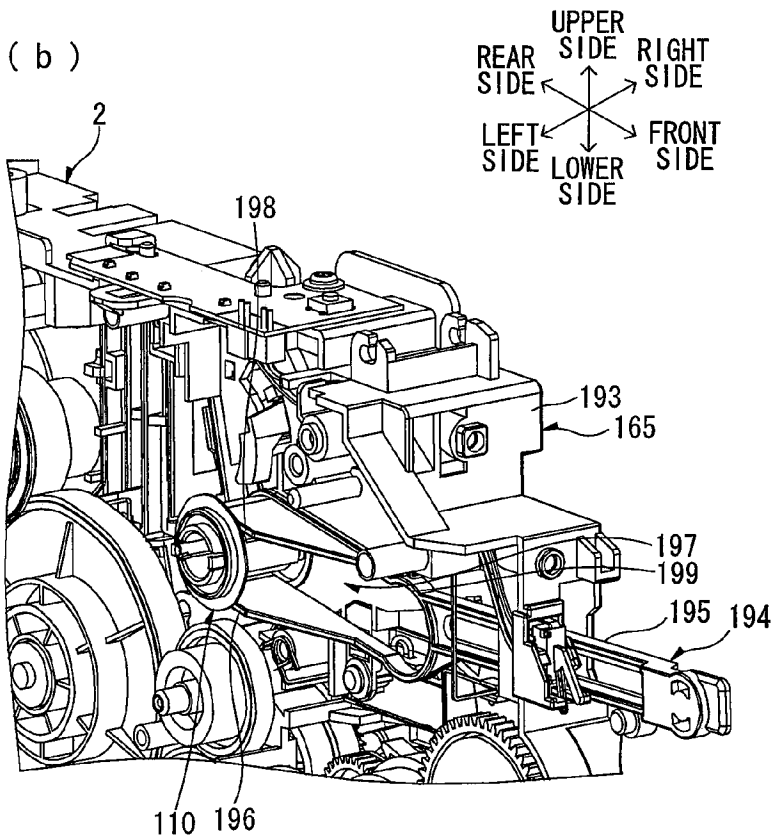

FIGS. 14(*a*) and 14(*b*) are a left side perspective view of the periphery of a driving gear and an arm for explaining an abutment state of the driving gear against the arm.

Figure 15:
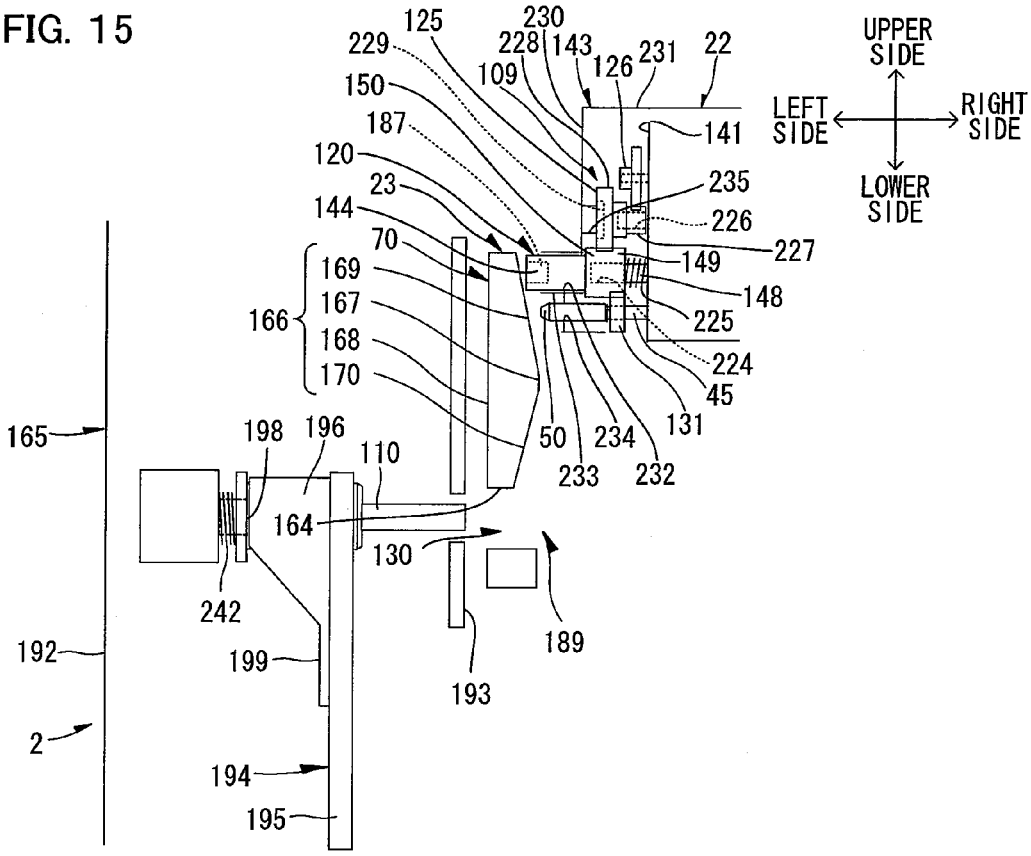
FIG. 15 is a front schematic sectional view of a drum subunit for explaining that a developer cartridge is attached to the drum subunit and that a driving gear is coupled to an input gear of the developer cartridge that has been attached in the drum subunit, showing the developer cartridge at the start of attaching (In FIGS. 15 through 18, for convenience of explanation, a moving direction of an arm is changed from the original front and rear direction to the up and down direction.)
Figure 16:
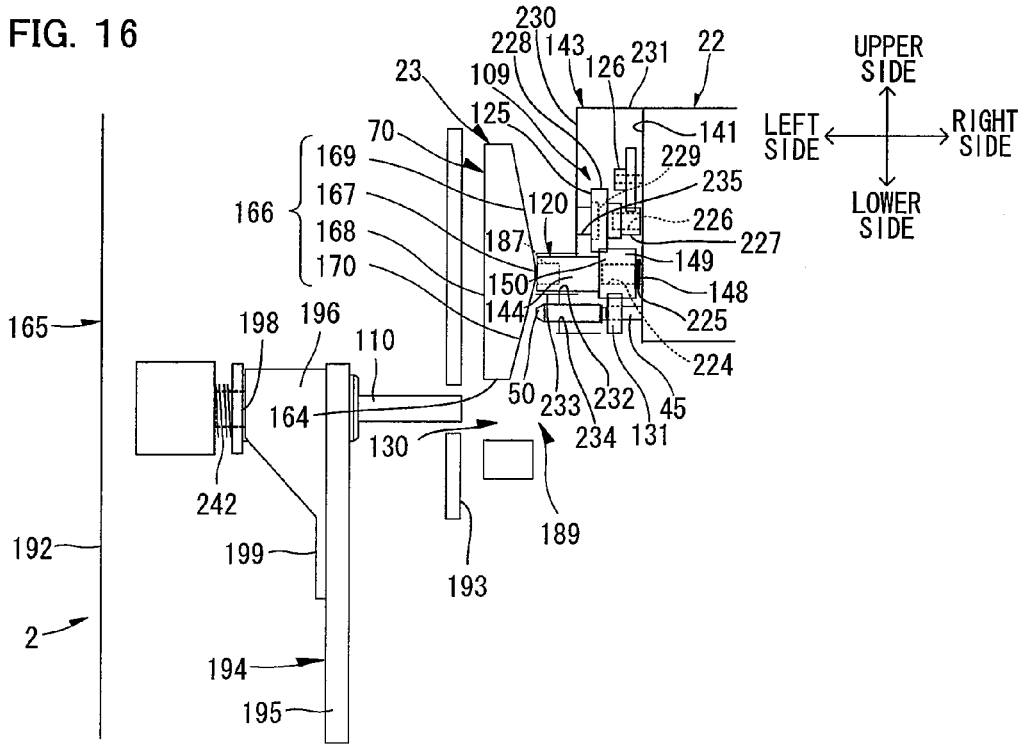
FIG. 16 shows the developer cartridge in FIG. 15 midway through attaching.
Figure 17:
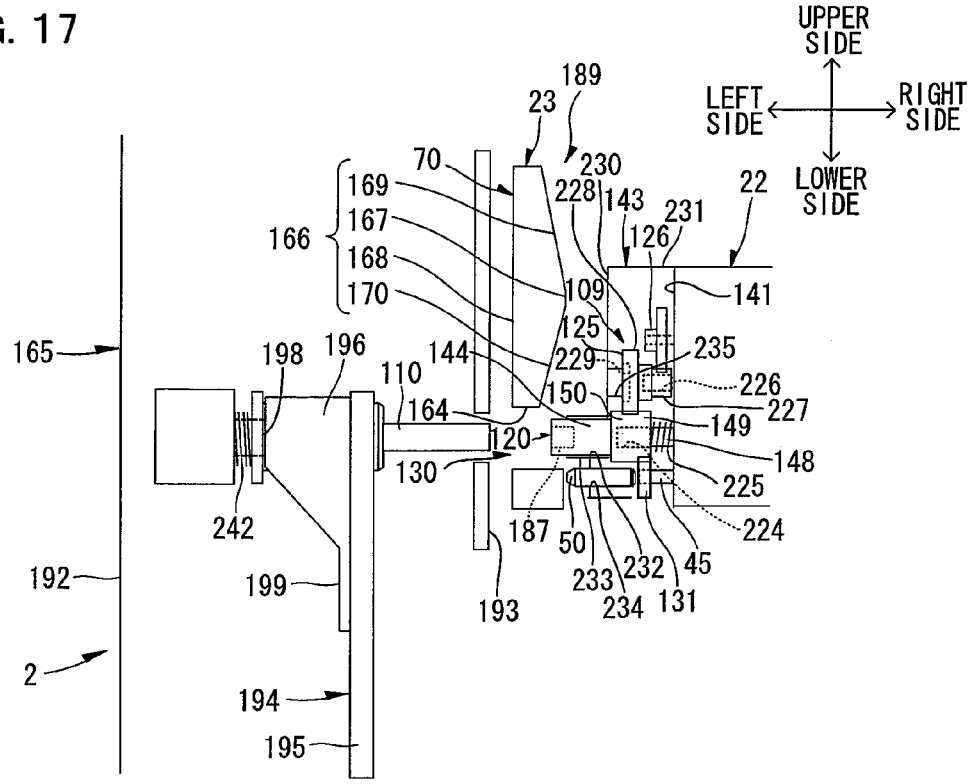
FIG. 17 shows the developer cartridge in FIG. 15 at the completion of attaching.
Figure 18:
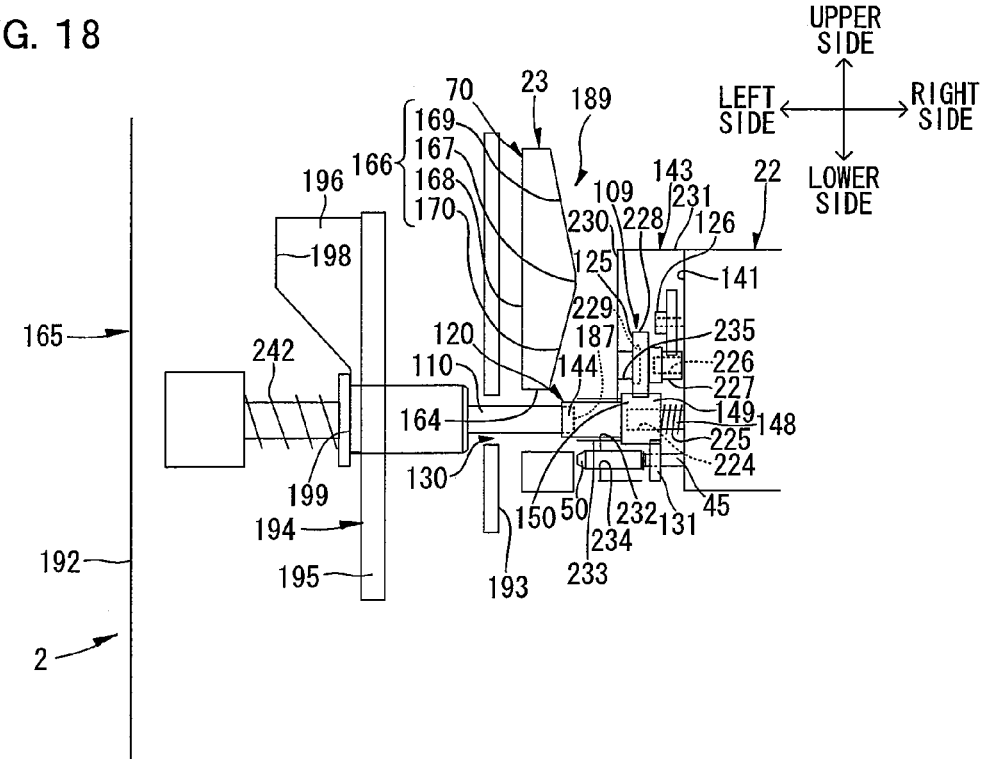
FIG. 18 shows a mode where the driving gear is coupled to the input gear of the developer cartridge in FIG. 17.

FIG. 15 is a front schematic sectional view of a drum subunit for explaining that a developer cartridge is attached to the drum subunit and that a driving gear is coupled to an input gear of the developer cartridge that has been attached to the drum subunit, showing the developer cartridge at the start of attaching. FIG. 16 shows the developer cartridge midway through the attaching; FIG. 17 shows the developer cartridge at the completion of the attaching; and FIG. 18 shows a mode where a driving gear is coupled to an input gear of the developer cartridge in FIG. 17. For convenience of explanation, a moving direction of the arm is changed from the original front and rear direction to the up and down direction.

Figure 19:
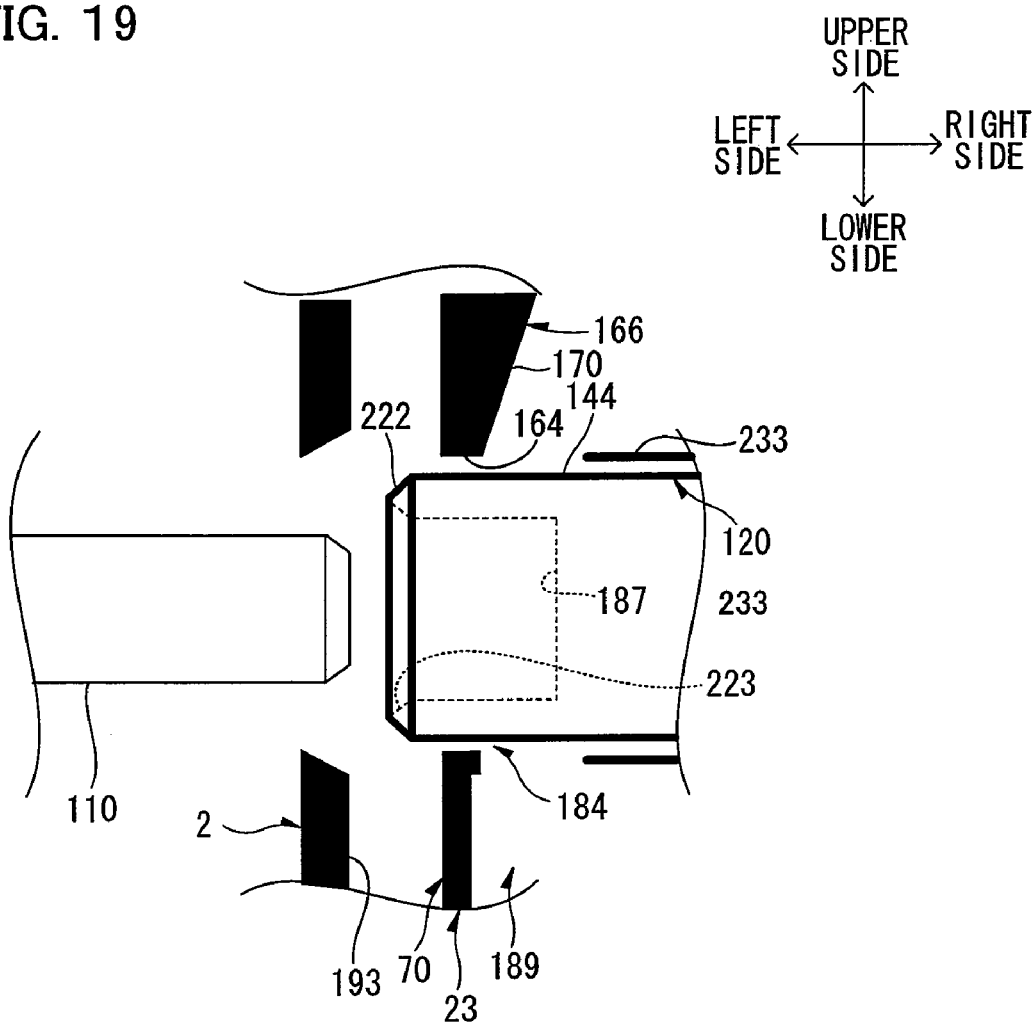
FIG. 19 shows opposed portions of the input gear and the driving gear excerpted in part from FIG. 17.

FIG. 19 shows opposed portions of the input gear and the driving gear excerpted in part from FIG. 17.

Next, the drum unit 21 will be described in detail with reference to FIGS. 8 through 10.

As shown in FIG. 9, the drum unit 21 includes four drum subunits 23 for the corresponding colors, a front beam 96 and a rear beam 111 that are arranged on each side of the front and rear direction of the four drum subunits 23 anteroposteriorly provided in parallel, and a pair of side plates 121 sandwiching the front beam 96, the four drum subunits 23, and the rear beam 111 therebetween in the width direction.

In the drum unit 21, these four drum subunits 23, front beam 96, rear beam 111, and pair of side plates 121 are all together slidably attached to or detached from the drum accommodation section 161 (see FIG. 1) of the main body casing 2.

(1) Drum Subunit

As shown in FIG. 8, the drum subunit 23 includes a left side frame 70 and a right side frame 71 that are spaced in opposed relation to each other in the width direction, and a center frame 72 extending between the left side frame 70 and the right side frame 71.

(1-1) Side Frames

The left side frame 70 and the right side frame 71 are formed of resin material. The left side frame 70 is formed generally in a triangle as viewed in side with tapering downward from above, and the right side frame 71 is formed generally in a parallelogram as viewed in side with inclining from the upper front side toward the lower rear side.

The right side frame 71 has a right guide groove 73 in its inner wall surface.

The right guide groove 73 is formed in the inner wall surface of the right side frame 71 so as to be recessed in a flat-bottomed U-shape in section outwardly in the width direction therefrom, and formed generally in the up and down direction from the rear upper end edge of the right side frame 71 to near the front lower end thereof. The upper end of the right guide groove 73 is wide and open upwardly. A collar member 50 (see FIG. 5) described later that is provided in the right end portion of the developing roller shaft 45 of the developer cartridge 22 is slidably received in such right guide groove 73.

The right side frame 71 has a boss 75 frontward of the right guide groove 73 on the upper side. Another boss 75 is provided on the left side frame 70 in an opposed position to the boss 75 on the right side frame 71 in the width direction. These bosses 75 are formed in a tubular shape so that the bosses 75 protrude outward in the width direction from the outer wall surfaces of the right side frame 71 and left side frame 70, and are arranged in opposed relation to the windows 142 (see FIG. 4) of the developer cartridge 22 in the width direction when the developer cartridge 22 is attached in the drum subunit 23.

The right side frame 71 has a support shaft portion 156 at its front end of the lower end portion of its right side surface. The support shaft portion 156 is formed in a cylindrical shape, and protrudes outward in the width direction (rightward) from the right side surface of the right side frame 71.

The right side frame 71 is also provided in its lower end portion with a shaft insertion hole 78 that penetrates therethrough in the thickness direction.

The right side frame 71 is provided at its rear end portion with two screw insertion holes 79 that allow insertion of screws (not shown) for assembling the right side frame 71 to the center frame 72, as penetrating therethrough in the thickness direction. One screw insertion hole 79 is formed at the lower end of the rear end portion of the right side frame 71, and the other screw insertion hole 79 is formed on the midway of the rear end portion thereof in the up and down direction.

The right side frame 71 supports a wire electrode 80, a grid electrode 81, a developing roller electrode 82, and a cleaning electrode 83, each penetrating the right side frame 71 in the thickness direction and protruding outward in the width direction from the outer wall surface.

The wire electrode 80 is arranged generally centrally within the right side frame 71 in the front and rear direction and the up and down direction, above the shaft insertion hole 78.

The grid electrode 81 is arranged on the midway of the rear end portion of the right side frame 71 in the up and down direction, and obliquely rearward above the shaft insertion hole 78.

The developing roller electrode 82 is arranged on the midway of the front end portion of the right side frame 71 in the up and down direction, and obliquely forward above the shaft insertion hole 78. A current supply coil 155 is connected to the developing roller electrode 82.

The current supply coil 155 is formed of one or more turns of electrically-conductive wire such as metal wire material. The current supply coil 155 includes two arm portions extending in separate directions from its winding portion. The winding portion is inserted through the support shaft portion 156 of the right side frame 71. One arm portion 158 is disposed obliquely forward along the front end edge of the right side frame 71, and its distal end is connected to the developing roller electrode 82. The other arm portion 159 is fixed on a hook 160, a portion thereof is bent rearwards from the portion fixed by the hook 160, and a portion from the portion fixed by the hook 160 to its distal end, is in a generally bow shape in side view. In the other arm portion 159, a convex 176 having the generally bow shape described above is protruded in side view from a notch 201 formed in the right guide groove 73 into the right guide groove 73 when the current supply coil 155 is in attachment (assembled) with the right side frame 71.

The cleaning electrode 83 is arranged on the midway of the rear end portion of the right side frame 71 in the up and down direction, above the grid electrode 81, and obliquely rearward above the shaft insertion hole 78.

The right side frame 71 is provided on its outer wall surface with a fitting peripheral wall 94 that semicircularly protrudes outward in the width direction and surrounds the wire electrode 80.

The left side frame 70 and the right side frame 71 are provided above their respective bosses 75 with ridges 84 extending anteroposteriorly. The respective ridges 84 protrude outward in the width direction from the outer wall surfaces of the respective side frames, and are anteroposteriorly formed in an elongated strip shape.

The left side frame 70 is generally triangle-shaped in side as described above, and a rear-side vertical wall 60 extending generally in the up and down direction is provided on its rear side surface. The rear-side vertical wall 60 has a rear-side recess 69 at its lower end portion. The rear-side recess 69 is generally in a circular-arc shape as viewed in side with the rear-side vertical wall 60 recessed frontward, so as to be continuous with the rear-side vertical wall 60. The upper end of the rear-side vertical wall 60 and the rear end portion of the upper side surface of the left side frame 70 are coupled together by an inclined surface extending obliquely upwardly forward.

The left side frame 70 is provided at its lower end portion with a threaded portion (not shown) that allows screwing of a screw 136 described later for assembling the left side frame 70 to the side plate 121.

The left side frame 70 is also provided at its upper end portion of the front side surface with a positioning projection 200 that protrudes forward of the front side surface thereof.

The left side frame 70 has a side wall opening 213 between the boss 75 and the rear-side vertical wall 60, the side wall opening having a generally elongated rectangular shape as viewed in side, extending in the up and down direction. The side wall opening 213 is provided at its upper end portion with a cylindrically-shaped lever support shaft 214 that is extended between the front edge and rear edge portions thereof.

As shown in FIG. 9, the lever support shaft 214 swingably supports a lever 206.

The lever 206 is formed in generally inverted L-shape as viewed in vertical section, having two end portions between which a lever swinging shaft 207 is interposed, the lever swinging shaft 207 being inserted through the lever support shaft 214. One of the two ends of the lever 206 protrudes rightward of the side wall opening 213, and the other end protruding leftward of the side wall opening 213.

(1-2) Center Frame

As shown in FIG. 8, the center frame 72 is formed of resin material, separately from the left side frame 70 and the right side frame 71. This center frame 72 unitarily includes a center plate 86 extending in the width direction, and a right side plate (not shown) and a left side plate 95 provided at opposite end portions of the center plate 86. The left side plate 95, and the aforementioned left side frame 70 and right side frame 71 function as a pair of guide walls.

The center plate 86 has a generally elongated plate shape in plan view, and is provided on the midway in the up and down direction along the width direction with a charger retaining portion 88 for retaining the scorotron charger 25.

The charger retaining portion 88 has a discharge wire 28 stretched across the width direction, and retains a grid 29 below the wire 28 (see FIG. 2). The charger retaining portion 88 also slidably retains in the width direction a wire cleaner 89 that pinches the discharge wire 28.

The center plate 86 has a blush retaining portion 93 for retaining a cleaning brush 68 below the charger retaining portion 88.

The blush retaining portion 93 retains the cleaning brush 68 across the width direction (see FIG. 2).

The center plate 86 is provided with a positioning roller 218 at both end portions of its upper end portion thereof in the width direction, at which the positioning roller 218 is rotatably supported by a roller support shaft 219 provided along the width direction.

The right side plate (not shown) and the left side plate 95 are formed at opposite end portions of the center plate 86 in the width direction, respectively, so as to be bent from the center plate 86 to extend frontward. The right side plate (not shown) and the left side plate 95 are generally triangular-shaped in side view and grow narrower in the upward direction.

The left side plate 95 is larger in size than the right side plate (not shown), and is formed generally in a right triangle, including a bottom wall 137 extending anteroposteriorly, a front vertical wall 138 extending generally upward from the front end portion of the bottom wall 137, and an inclined wall 139 which connects the rear end portion of the bottom wall 137 to the upper end portion of the front vertical wall 138. The upper end of the front vertical wall 138 and the upper end of the inclined wall 139 are connected via the inclined surface extending obliquely rearward and upward.

The front vertical wall 138 has a front recess 152 generally at its center position. The front recess 152 is formed generally in a circular-arc shape as viewed in side and is recessed rearward so as to be continuous with the front vertical wall 138.

The front vertical wall 138 has a groove-like deepest portion that is continuously recessed obliquely rearward and downward from the lower end portion of the front recess 152. The deepest portion corresponds to the position of the developing roller shaft 45 when the developer cartridge 22 is attached in the drum subunit 23 and the developing roller 34 is in contact with the photosensitive drum 24.

The front vertical wall 138 unitarily has a guide side wall 166 between the upper end portion of the front vertical wall 138 and a position slightly above the front recess 152, the guide side wall 166 being a side wall extending forward from the left side edge of the front vertical wall 138.

The guide side wall 166 is formed generally in a rectangle as viewed in side and generally in an isosceles trapezoid as viewed in front section, which includes an upper base 167, a lower base 168, an upper inclined portion 169 as a second wall portion, and a lower inclined portion 170 as a first wall portion.

The right side view of the lower base 168 is generally rectangular-shaped, which is equal to the right side view of the guide side wall 166. The left side surface of the lower base 168 is formed so as to be flush with the left side surface of the left side plate 95. A bottom recess 164 having a generally a circular-arc shape is formed at the lower end edge portion of the lower base 168, the bottom recess 164 having almost the same curvature as the front recess 152 in the right side view.

The upper base 167 is arranged generally at the center position of the lower base 168 in the up and down direction so that the upper base 167 is generally parallel to the left side surface of the lower base 168 in the up-to-down and front-to-rear directions and disposed rightward of the lower base 168. The upper base 167 has the same front-to-rear length as the lower base 168, and about one-fifth of the up-to-down length of the lower base 168.

The upper inclined portion 169 is formed as an inclined surface that inclines rightwardly from top to bottom so as to connect the upper end of the lower base 168 with the upper end of the upper base 167.

The lower inclined portion 170 is formed as an inclined surface that inclines leftwardly from top to bottom so as to connect the lower end of the lower base 168 with the lower end of the upper base 167.

A positioning recess 202 is provided in a position generally two-third lower than the size of the inclined wall 139 in the up and down direction from the upper end portion of the inclined wall 139.

The left side plate 95 has in its lower end portion the shaft insertion hole 78 that penetrates the left side plate 95 in the thickness direction.

The left side plate 95 is provided in its left side surface with a threaded portion (not shown) that allows screwing of a screw (not shown) for assembling each side plate 121 to the drum subunit 23. The left side plate 95 has on its upper side the above-mentioned ridge 84 (not shown) extending anteroposteriorly.

(1-3) Assembling of the Drum Subunit

The right side frame 71 is arranged on the right side of the center frame 72 so that the shaft insertion hole 78 in the right side frame 71 and the shaft insertion hole 78 in the center frame 72 are overlapped with each other in side view. Then, a screw (not shown) is inserted through each screw insertion hole 79 in the right side frame 71, and subsequently, is screwed into the each threaded portion (not shown) in the center frame 72. Thus, the right side frame 71 is mounted to the right side of the center frame 72.

When the right side frame 71 is completely mounted to the right side of the center frame 72, the wire electrode 80 and grid electrode 81 that are provided in the right side frame 71 are connected to the discharge wire 28 and grid 29 of the center frame 72, respectively. The cleaning electrode 83 is connected to the cleaning brush 68.

Whereas the right side frame 71 is mounted to the right side of the center frame 72, the left side frame 70 is mounted to neither the center frame 72 nor the right side frame 71, but to the side plate 121 described later. Then, the center frame 72 mounted with the right side frame 71, is mounted to the side plate 121 mounted with the left side frame 70. Thus, the assembly of the drum subunit 23 is completed.

When the drum subunit 23 is completely assembled, the front vertical wall 138 of the left side plate 95 of the center frame 72 is anteroposteriorly opposed to the rear-side vertical wall 60 of the left side frame 70, whereby the front vertical wall 138 and the rear-side vertical wall 60 define a left guide groove 189 as a guide groove.

The front recess 152 of the left side plate 95 and the rear-side recess 69 of the left side frame 70 are anteroposteriorly opposed to each other, and each of the generally circular-arc portions in side view and the bottom recess 164 of the guide side wall 166 described above are combined together, whereby a coupling inner insertion portion 74 having a circular shape in side view is formed. The coupling inner insertion portion 74 has a size capable of inserting the driving gear 110 described later therethrough.

The front end edge of the guide side wall 166 of the left side plate 95 abuts against anteroposteriorly generally the center portion of the left side end portion of the rear-side vertical wall 60 of the left side frame 70.

As shown in FIG. 9, the drum subunit 23 retains the photosensitive drum 24. First, the drum body 26 to which the rotation support member 30 is to be relatively unrotatably fitted, is arranged between the right side frame 71 and the left side plate 95 so as to be spaced in parallel to the scorotron charger 25. Subsequently, along the axis of the drum body 26, the drum shaft 27 is inserted through each of the shaft insertion holes 78 (see FIG. 8) in the center frame 72 and right side frame 71, so that the drum shaft 27 is relatively unrotatably fixed thereto. Then, the rotation support member 30 that relatively unrotatably supports the drum body 26 is relatively rotatably supported by this drum shaft 27, whereby the photosensitive drum 24 is retained in the drum subunit 23.

(2) Front Beam

The front beam 96 is arranged on the front side of the four drum subunits 23 which are anteroposteriorly disposed in parallel to one another, and is extended between the pair of side plates 121.

As shown in FIG. 10, the front beam 96 includes a pair of frontal side walls 97 arranged in opposed relation to each other in the width direction, and a frontal front wall 98 and a frontal rear wall 99 both of which are extended between the pair of frontal side walls 97, and is unitarily formed of resin material.

Each frontal side wall 97 includes a frontal side wall base portion 100 having a shape of a generally rhombic plate as viewed in side, a frontal side wall foot portion 101 extending downward from the lower end of the frontal side wall base portion 100. The frontal side wall base portion 100 is provided in its outer wall surface with a frontal threaded portion 103 that allows screwing of a screw 136 described later for assembling each side plate 121.

Each of the frontal side walls 97 has a shaft receiving hole 203 formed on the front side of the frontal threaded portion 103 so as to penetrate the front beam 96 in the width direction. The shaft receiving hole 203 has a positioning shaft 204 inserted therethrough so that both end portions of the positioning shaft 204 protruding outward from each frontal side wall 97 in the width direction.

In the frontal side wall 97, the rear end face thereof that is continuous from the frontal side wall base portion 100 to the frontal side wall foot portion 101 is formed as a front-side inclined surface 102 that inclines from the upper front side toward the lower rear side.

The frontal front wall 98 is generally in the shape of an elongated rectangular plate in front view, extending in the width direction, and is arranged between the pair of frontal side walls 97 along the up and down direction.

The frontal front wall 98 is provided with a front-side grasp portion 104 in the center of the width direction. The front-side grasp portion 104 includes a pair of grasp side plates 105 that are spaced in opposed relation to each other in the width direction, and a grasp center plate 106 that extends between the grasp side plates 105.

The proximal edge (the end portion not connecting to the grasp center plate 106) of each grasp side plate 105 is rotationally supported by the positioning shaft 204, so that the front-side grasp portion 104 is swung to an accommodation position in a generally upright state (illustrated by a dashed line), and to an operation position (illustrated by a solid line) in a generally horizontally inclined state.

As shown in FIG. 9, the frontal rear wall 99 is generally in the shape of an elongated rectangular plate in rear view, extending in the width direction, and is arranged on the rear side of the frontal front wall 98. The frontal rear wall 99 is extended between the frontal side walls 97, while inclining from the upper front side toward the lower rear side along the front-side inclined surface 102 of each frontal side wall 97.

The frontal rear wall 99 includes the positioning roller 218 and the roller support shaft 219 both described above, generally at the center position of the up and down direction at each of its both end portions. Each of the roller support shafts 219 is arranged so as to be almost embedded in the frontal rear wall 99, and each of the positioning rollers 218 is arranged such that a part of its outer peripheral surface protrudes from the frontal rear wall 99 as viewed in side.

(3) Rear Beam

The rear beam 111 is arranged on the rear side of the four drum subunits 23 that are anteroposteriorly disposed in parallel to one another, and is extended between the pair of side plates 121.

As shown in FIG. 10, the rear beam 111 includes a pair of rear side walls 112 arranged in opposed relation to each other in the width direction, and a rear extension wall 113 extended between the pair of rear side walls 112, and is unitarily formed of resin material.

Each of the rear side wall 112 is formed generally in the shape of a triangular plate as viewed in side, growing narrower in the downward direction, and is provided in its outer side surface in the width direction with two rear threaded portions 114, one in the upper end portion of the outer side surface, and the other generally in the center portion thereof, each of which allows screwing of a screw 136 for mounting each side plate 121. The rear side wall 112 has a rear side wall foot portion 107 below the rear threaded portion 114 provided generally in the center portion thereof. The rear side wall 112 is provided between the rear threaded portion 114 generally in the center portion and the upper end portion of the rear side wall foot portion 107 with a rear side wall notched portion 108 that is recessed frontward.

The front end face of the rear side wall 112 is formed as a rear-side inclined surface 115 which inclines from the upper front side toward the lower rear side.

The rear extension wall 113 is generally in the shape of an elongated rectangular plate in front view, extending in the width direction, and is arranged between the pair of rear side walls 112 along the up and down direction.

The rear extension wall 113 is provided with a back-side grasp portion 116 in its center of the width direction. As shown in FIG. 9, the back-side grasp portion 116 includes a grasp recess 117 having a generally recess shape in rear view in which the upper end portion of the rear extension wall 113 is recessed downward, and a rear grip 118 having a generally flat-bottomed U-shape in rear view being coupled to the upper end portion of the rear extension wall 113 so as to straddle the grasp recess 117 in the width direction.

(4) Side Plates

The side plates 121 are provided as a pair so that the front beam 96, the four drum subunits 23 and the rear beam 111 can be sandwiched from the both sides of the width direction.

Each side plate 121 is formed of a material having a lower coefficient of linear expansion than that of the resin material for the drum subunit 23, such as metal or fiber reinforced resin, preferably of metal.

Each of the side plate 121 is formed in the shape of a generally elongated rectangular plate as viewed in side, extending in the front and rear direction. In the assembly of the drum unit 21 described later, the front end portion of the side plate 121 is opposed to the front beam 96, and the rear end portion thereof is opposed to the rear beam 111, with respect to the front beam 96, the four drum subunits 23, and the rear beam 111 which are anteroposteriorly disposed in parallel to one another. Furthermore, the upper end portion thereof is opposed to the ridges 84 of the left side plate 95 of the center frame 72, the left side frame 70, and the right side frame 71 of the drum subunit 23, while the lower end portion thereof is opposed to the lower end portions of the left side plate 95 of the center frame 72, the left side frame 70, and the right side frame 71 of the drum subunit 23.

The upper end portion of each side plate 121 is bent outward in the width direction to be in a L-shape in section, and has a flange portion 122 extending outward in the width direction across the front and rear direction. Each of the side plates 121 has two rollers 177 rotatably provided at its rear end portion. These two rollers 177 are anteroposteriorly arranged in spaced relation with a spacer 178 interposed therebetween. The front roller 177 is arranged below the flange portion 122 and in spaced relation thereto in the up and down direction, while the rear roller 177 is arranged in spaced relation to the rear end portion of the flange portion 122.

Each side plate 121 is also provided with a notched portion 179 in the lower end portion of its rear end edge. The notched portion 179 is formed generally in a U-shape as viewed in side so as to be continuous with the rear end edge and to be recessed frontward.

Each side plate 121 is provided in its upper end portion with four light passing holes 123 that receive the bosses 75 of the respective drum subunits 23 in the state where the drum subunits 23 are mounted with the respective side plates 121.

The four light passing holes 123 are anteroposteriorly arranged in spaced relation to one another in the upper end portion of each side plate 121. Each light passing holes 123 is formed as a round hole which penetrates the side plates 121 in the thickness direction, at a position where the window 142 (see FIG. 4) of a developer cartridge 22 is opposed to boss 75 (see FIG. 8) of the drum subunit 23 in the width direction, in the state where the developer cartridge 22 is attached in the drum subunit 23.

Each side plate 121 is provided at its lower end portion with shaft holes 124 that allow insertion of the respective axial end portions of the drum shafts 27 in the respective drum subunit 23.

Each side plate 121 is provided at its front end portion with a front screw insertion hole 128 that allows insertion of the screw 136 and is in opposed relation to the frontal threaded portion 103 (see FIG. 10) of the frontal side wall base portion 100 in the state where the side plates 121 are mounted on the front beam 96. A shaft exposing hole 216 is formed obliquely above the front side of the front screw insertion hole 128 in each side plate 121.

Each side plate 121 is provided at its rear end portion with two rear screw insertion holes 129 that allow insertion of a screw 136 and is in opposed relation to the respective rear threaded portions 114 (see FIG. 10) of the rear side wall 112 in the state where the side plates 121 are mounted on the rear beam 111. One of the two rear screw insertion holes 129 is formed generally at the center position of the spacer 178 in the front and rear direction.

In the left-side side plate 121, coupling outer insertion holes 130 are formed so as to be each opposed to the input gear 120 of each developer cartridge 22 in the width direction in the state where the both side plates 121 are mounted on the drum subunits 23, and further, where the developer cartridges 22 are attached in the corresponding drum subunits 23. An intermediate screw insertion hole (not shown) for inserting the screw 136 therethrough is formed between the front screw insertion hole 128 and the rear screw insertion hole 129 of the left-side side plate 121, corresponding to each drum subunit 23, and is opposed to the aforementioned threaded portion (not shown) of each left side frame 70 in the state where the left-side side plate 121 is mounted on the drum subunit 23.

Four coupling outer insertion holes 130 are anteroposteriorly arranged in spaced relation to one another in the center of the side plate 121 in the up and down direction. Each coupling outer insertion hole 130 is formed as a round hole which penetrates the side plate 121 in the thickness direction, at a position opposed to the coupling inner insertion portion 74 (see FIG. 8) formed in the left side surface of the drum subunit 23 in the width direction in the state where the side plate 121 is mounted on the drum subunit 23, and further, where the developer cartridge 22 is attached in the corresponding drum subunit 23.

In the upper end portion of the left-side side plate 121, four lever passing holes (not shown) are formed in a spaced relation from one another on the rear side of the respective light passing holes 123, in order to receive the respective other ends of the levers 206 in the drum subunits 23, and the other ends protrude leftward of the side wall opening 213 (see FIG. 8) described above in the state where the left-side side plate 121 is mounted on the drum subunits 23.

Center openings 133 are formed in the right-side side plate 121 in order to expose the respective wire electrodes 80 and grid electrodes 81 which are provided in the respective right side frames 71 outward in the width direction with respect to the right-side side plate 121 in the state where the both side plates 121 are mounted on the drum subunits 23.

The four center openings 133 are anteroposteriorly arranged in spaced relation to one another. Each of the center openings 133 is formed as a large opening which allows fitting of the fitting peripheral wall 94 (see FIG. 8) including the wire electrode 80 and insertion of the grid electrode 81.

A front opening 134 is formed on the front side of each of the center openings 133 in the right-side side plate 121 in order to expose the developing roller electrode 82 outward in the width direction with respect to the right-side side plate 121 in the state where the both side plates 121 are mounted on the drum subunits 23. The four front openings 134 are arranged corresponding to the respective center openings 133 and opposed to the respective developing roller electrodes 82 in the width direction in the state where the both side plates 121 are mounted on the drum subunits 23.

A rear opening 135 is formed on the rear side of each of the center openings 133 in the right-side side plate 121 to expose the cleaning electrode 83 outward in the width direction with respect to the right-side side plate 121 in the state where the both side plates 121 are mounted on the drum subunits 23. The four rear openings 134 are arranged corresponding to the respective center openings 133, and opposed to the respective cleaning electrodes 83 in the width direction in the state where the both side plates 121 are mounted on the drum subunits 23.

(5) Assembling of Drum Unit

First, the four drum subunits 23 are anteroposteriorly disposed so as to be adjacent to one another. To do so, as shown in FIG. 8, in the mutually adjacent drum subunits 23, the positioning projection 200 of the left side frame 70 of the drum subunit 23 at the rear is fitted into the positioning recess 202 of the left side plate 95 of the center frame 72 of the drum subunit 23 at the front, and the front end face of the right side frame 71 of the drum subunit 23 at the rear is abutted against the rear end face of the right side frame 71 of the drum subunit 23 at the front. Thus, the drum subunits 23 are anteroposteriorly arranged adjacent to one another with each inclining from the upper front side toward the lower rear side.

Then as shown in FIG. 9, the front beam 96 and the rear beam 111 are disposed so as to be adjacent to the foremost drum subunit 23 and the rearmost drum subunit 23, respectively. To dispose the front beam 96 so as to be adjacent to the foremost drum subunit 23, the front end faces of the left side frame 70 and right side frame 71 of the foremost drum subunit 23 are abutted against the front-side inclined surface 102 of the front beam 96. At this time, the positioning projection 200 (see FIG. 8) of the left side frame 70 of the foremost drum subunit 23 is fitted into the positioning recess (not shown) formed in the left end portion of the front-side inclined surface 102. Further, to dispose the rear beam 111 so as to be adjacent to the rearmost drum subunit 23, the rear end faces of the left side plate 95 and the right side frame 71 of the rearmost drum subunit 23 are abutted against the rear-side inclined surface 115 of the rear beam 111.

The side plates 121 are arranged on both sides of the width direction of the front beam 96, the four drum subunits 23 and the rear beam 111 which are anteroposteriorly disposed, and then, the side plates 121 are mounted thereto via screws 136.

At this time, in the side plate 121 on the left side, the front screw insertion hole 128, the rear screw insertion hole 129, and the above-mentioned intermediate screw insertion hole are arranged in opposed relation in the width direction to the left-side frontal threaded portion 103 (see FIG. 10) of the front beam 96, the left-side rear threaded portion 114 (see FIG. 10) of the rear beam 111, and the threaded portion (not shown) of the left side frame 70 of each drum subunit 23, respectively.

Subsequently, the inner wall surface of the side plate 121 on the left side is abutted against the ridge 84 of the left side frame 70 and the ridge 84 of the center frame 72 of the drum subunit 23 (see FIG. 8). At this time, the axial left-side end portion of the drum shaft 27 is inserted through the shaft hole 124, and the boss 75 of the left side frame 70 of each drum subunit 23 is fitted into each light passing hole 123 so that the boss 75 is exposed outward in the width direction.

Then, the screws 136 are inserted through the front screw insertion hole 128, the rear screw insertion holes 129, and the intermediate screw insertion hole (not shown), so as to be screwed into the frontal threaded portion 103, the rear threaded portion 114 (see FIG. 10), and the threaded portion (not shown) of each drum subunit 23, respectively.

In the side plate 121 on the right side, the front screw insertion hole 128 and the rear screw insertion holes 129 are arranged in opposed relation in the width direction to the right-side frontal threaded portion 103 of the front beam 96 and the right-side rear threaded portions 114 of the rear beam 111 (see FIG. 10), respectively.

Subsequently, the inner wall surface of the right-side side plate 121 is abutted against the ridge 84 (see FIG. 8) of the right side frame 71 of each drum subunit 23. At this time, the axial right-side end portion of the drum shaft 27 is inserted through each shaft hole 124 of the right-side side plate 121, and the boss 75 of the right side frame 71 of each drum subunit 23 is fitted into the light passing hole 123 so that the boss 75 is exposed outward in the width direction. Further, the fitting peripheral wall 94 (see FIG. 8) of each drum subunit 23 is fitted into the center opening 133.

Then, the screws 136 are inserted through the front screw insertion hole 128 and the rear screw insertion holes 129, to be screwed into the frontal threaded portion 103 and the rear threaded portions 114 (see FIG. 10), respectively.

In the drum unit 21 thus assembled, the opposite axial end portions of the drum shaft 27 that is supported between the left side plate 95 and the right side frame 71 of the center frame 72 in each drum subunit 23, are inserted through the respective shaft holes 124 in the both side plates 121. In such inserted state, the axial end portions of the drum shaft 27 are urged obliquely rearward to the upper side by a wire spring (not shown) to abut against the peripheral edge of the shaft hole 124. Thus, the opposite axial end portions of the drum shaft 27 are positioned between the pair of side plates 121.

The opposite axial end portions of the positioning shaft 204 of the front beam 96, are inserted through the respective shaft exposing holes 216 of the side plates 121, so that the positioning shaft 204 is exposed outward from the respective side plates 121 in the width direction.

In the drum unit 21 thus assembled, each coupling outer insertion hole 130 formed in the left-side side plate 121 is opposed to the coupling inner insertion portion 74 in each drum subunit 23 in the width direction.

In the drum unit 21 thus assembled, the grid electrode 81 and the wire electrode 80 are exposed outward in the width direction from each center opening 133 formed in the right-side side plate 121, and the developing roller electrode 82 and the cleaning electrode 83 are exposed outward in the width direction from each front opening 134 and each rear opening 135.

Right caps 181 are provided on the lower half of the right-side side plate 121 of the drum unit 21, as corresponding to the respective drum subunits 23. Each of the right caps 181 is formed in a trapezoidal sheet as viewed in side, made of insulating rubber or sponge. While exposing the drum shaft 27, the developing roller electrode 82, the wire electrode 80, the grid electrode 81, and the cleaning electrode 83, the right cap 181 closes the center opening 133, the front opening 134, and the rear opening 135.

3. Developer Cartridge

Next, the developer cartridge 22 will be described in detail with reference to FIGS. 4 through 7 and FIGS. 15 through 19.

(1) Developer Cartridge

As described above, the developing roller 34 is arranged in the developer cartridge 22 so as to be exposed downward from the developer opening 36 at the lower end of the developer frame 31, as shown in FIG. 4. The developing roller shaft 45 of the developing roller 34 is rotatably supported on both side walls 141 of the developer frame 31, and the opposite axial end portions thereof are provided so as to protrude to the both sides of the width direction from the both side walls 141 of the developer frame 31. As shown in FIG. 5, the opposite axial end portions of the developing roller shaft 45 are respectively covered with collar members 50 formed of electrically-conductive resin or the like. A collar inclined surface 185 is formed between the left end face and the outer peripheral surface of the left-side collar member 50 by being cut off to connect these surfaces.

A current supply cylindrical portion 90, which is formed of electrically-conductive resin or the like, is provided on the right-side side wall 141 so as to protrude in an upper position of the right-side collar member 50. The current supply cylindrical portion 90 is formed in a generally drop-like shape larger than the collar member 50 as viewed in side, and its right end edge is in an equal position to the right end edge of the right-side collar member 50 in the width direction. The current supply cylindrical portion 90 and the right-side collar member 50 are coupled to each other via the coupling portion (not shown) formed of electrically-conductive resin or the like.

A spacing projection 212 is formed in the rear end portion of the upper end portion of each side wall 141 of the developer frame 31. The spacing projection 212 is formed as a hollow cylindrical body which protrudes outward in the width direction from each side wall 141.

A positioning projection 217 is formed in the vicinity of the window 142 at each end portion of the front side wall of the developer frame 31 in the left and right direction.

The positioning projection 217 is formed in a trapezoid as viewed in side, and is convexed so as to be spaced from the front side wall of the developer frame 31.

The aforementioned window 142 is embedded in each sidewall 141 of the developer frame 31. These windows 142 allow to pass a detection light in the width direction for optically detecting the amount of toner remaining in the toner accommodation chamber 37 with an optical sensor including a light emitting element and a light receiving element, both of which are not shown, provided in the main body casing 2.

The developer cartridge 22 is provided on the left-side side wall 141 thereof with a gear mechanism 109 covered with the gear cover 143 (see FIG. 6) as a restricting member.

The gear mechanism 109 is provided for inputting a rotational driving force to the developing roller 34, the feed roller 33, and the agitator 32, and includes an input gear 120 to which a driving force is imparted from a driving gear 110 (described later) as a second rotation body provided in the main body casing 2, an intermediate gear 125 that meshes with the input gear 120, an agitator driving gear 126 that meshes with the intermediate gear 125, a developing roller driving gear 131 as a third rotation body that meshes with the input gear 120, a feed roller driving gear 140 that meshes with the input gear 120, and a detecting gear 205. The intermediate gear 125, the developing roller driving gear 131, and the feed roller driving gear 140 function as meshing members.

In the lower portion of the left-side side wall 141, the input gear 120 is axially slidably and rotatably supported by an input gear support shaft 148 (see FIG. 15) as a guide member which protrudes outward in the width direction. The input gear 120 is arranged above the developing roller shaft 45 so as to be at least partially overlapped with the left end portion of the developing roller shaft 45 of the developing roller 34 when projected from below.

The input gear 120 is unitarily formed with two gears having different diameters which sequentially become smaller from the right side (proximal edge) to the left side (distal end), and unitarily includes an inner teeth gear 149 as a meshing portion arranged at its proximal edge, and a coupling gear 144 as a coupling portion arranged at its distal end.

The inner teeth gear 149 is formed in a cylindrical shape having inner teeth 150 formed on the outer peripheral surface thereof.

The coupling gear 144 is coaxially arranged with the inner teeth gear 149, and is formed in a cylindrical shape which is smaller in diameter and axially longer in length than the inner teeth gear 149. The coupling gear 144 is provided with a coupling insertion hole 187 which is cylindrically recessed rightward from its left end face, and the inner peripheral surface of the coupling insertion hole 187 is provided with a pair of keys 221 protruded inward in the radial direction. The keys 221 are formed so as to protrude in the direction approaching to each other from the opposed positions where the keys 221 are displaced by 180° along the inner peripheral surface of the coupling gear 144.

A gear inclined surface 222 (see FIG. 19) is formed between the distal end face and the outer peripheral surface of the coupling gear 144, as an inclined surface cut off to connect them.

Further, a key inclined surface 223 (see FIG. 19) is formed between the distal end face of the coupling gear 144 and the inner peripheral surface of the coupling insertion hole 187, by being cut off so as to connect these surfaces.

As shown in FIG. 15, the inner teeth gear 149 of the input gear 120 is provided with a shaft insertion recess 224 that is formed by recessing the inner teeth gear 149 leftward from its right end face, so that the input gear support shaft 148 is inserted therethrough.

The input gear 120 is axially slidably and rotatably supported by the input gear support shaft 148 by inserting the input gear support shaft 148 through the shaft insertion recess 224. This allows the input gear 120 to be retractably guided in the axial direction, i.e., in the left and right direction, along the input gear support shaft 148, while the inner teeth 150 maintains the meshing state with the developing roller driving gear 131 and the feed roller driving gear 140 and the meshing state with the intermediate gear 125, as described later.

A coil spring 225 as an urging member is fitted on the outside of the input gear support shaft 148. The coil spring 225 is provided around the input gear support shaft 148 so as to extend along the axial direction thereof and interposed between the side wall 141 on the left side and the input gear 120. The coil spring 225 includes a compression spring, and its right side end portion abuts against the side wall 141, and its left side end portion abuts against the right-side end face of the inner teeth gear 149 of the input gear 120, thereby normally urging the input gear 120 in the advance direction (left side, i.e., outward in the width direction) described later.

The intermediate gear 125 is rotatably supported by an intermediate gear support shaft 226 that protrudes outward in the width direction from above the input gear 120 in the side wall 141. The intermediate gear 125 unitarily includes an inner teeth gear 227 on its right side (on the proximal edge side), and an outer teeth gear 228 having a larger diameter than the inner teeth gear 227 and a generally T-shape as viewed in front section on its left side (on the distal end side). The outer teeth gear 228 of the intermediate gear 125 meshes with the inner teeth gear 149 of the input gear 120. A support recess 229 is formed in the outer teeth gear 228 of the intermediate gear 125 so as to recess rightward from its left end face.

As shown in FIG. 4, the agitator driving gear 126 is relatively unrotatably provided at the left-side shaft end portion of the agitator rotating shaft 41 that penetrates the left-side side wall 141 to protrude outward in the width direction, obliquely forward above the upper side of the intermediate gear 125 in the side wall 141. As shown in FIG. 15, the agitator driving gear 126 meshes with the inner teeth gear 227 of the intermediate gear 125.

As shown in FIG. 4, the developing roller driving gear 131 is relatively unrotatably provided at the left-side shaft end portion of the developing roller shaft 45 that penetrates the left-side side wall 141 to protrude outward in the width direction, particularly rightward from the collar inclined surface 185 (see FIG. 5), below the input gear 120 in the side wall 141. The developing roller driving gear 131 meshes with the inner teeth gear 149 (see FIG. 5) of the input gear 120.

The feed roller driving gear 140 is relatively unrotatably provided at the left-side shaft end portion of the feed roller shaft 43 that penetrates the left-side side wall 141 to protrude outward in the width direction, on the front side of the input gear 120 in the side wall 141. The feed roller driving gear 140 is arranged in spaced relation to the developing roller driving gear 131 and meshes with the inner teeth gear 149 (see FIG. 5) of the input gear 120.

As shown in FIG. 5, the detecting gear 205 is rotatably supported on the left-side shaft end portion of the detecting gear support shaft 239 that penetrates the left-side side wall 141 to protrude outward in the width direction, above the agitator driving gear 126.

The detecting gear 205 is formed as a gear having a non-toothed portion, and is provided at its right end portion with a toothed portion 240 and a non-toothed portion 241, and at its left end portion with a guide rail 91 having an endless shape which protrudes outward in the width direction along the side surface shape of the detecting gear 205. The guide rail 91 unitarily includes a generally semicircular arc portion 85 and a horn portion 92 having a generally M-shape which couples the both ends of the generally semicircular arc portion 85 and has two vertices outward in the radial direction of the detecting gear 205, as viewed in left side. The generally semicircular arc portion 85 is provided at its ends with detection projections 238 that protrude leftward.

As shown in FIG. 4, a boss member 119 protruding outward in the width direction (leftward) is provided on the left-side side wall 141. The boss member 119 has a coil spring 127 wound around, and one end portion of the coil spring 127 is fixed to the left-side side wall 141, and the other end portion engaged with one horn portion 92. Thus, the coil spring 127 urges the toothed portion 240 (see FIG. 5) of the detecting gear 205 so that it meshes with the agitator driving gear 126.

The detection projection 238 is provided so as to correspond to information on the developer cartridge 22, specifically, information whether the developer cartridge 22 is new or used, or information on the number of sheets that can be printed with the developer cartridge 22. When the drum unit 21 attached with the developer cartridge 22, is attached in the main body casing 2, the driving force from the motor (not shown) in the main body casing 2 is transmitted to the toothed portion 240 of the detecting gear 205 via the input gear 120, the intermediate gear 125, and the agitator driving gear 126, whereby the detecting gear 205 is rotated.

Then, in response to the rotation of the detecting gear 205, the detection projection 238 of the detecting gear 205 abuts against one end of the above-mentioned lever 206 (see FIG. 9) provided on the drum subunit 23. As shown in FIG. 9, this abutment allows the lever 206 to swing about the lever swinging shaft 207, so that the other end of the lever 206 described above protrudes leftward from the lever passing hole (not shown) of the left-side side plate 121, and is detected by the detection sensor (not shown) provided in the main body casing 2. Then, the CPU (not shown) in the main body casing 2 judges the aforementioned information on the developer cartridge 22 based on the detection results by the detection sensor (not shown), such as the number of detection of the lever 206 and the time required for one detection. As shown in FIG. 5, when the detecting gear 205 rotates so that the non-toothed portion 241 is in opposed relation to the agitator driving gear 126, the rotation of the detecting gear 205 is terminated. At this time, the aforementioned one end portion of the coil spring 127 is seized by the other horn portion 92 that is different from the aforementioned one horn portion 92, whereby the opposed state of the non-toothed portion 241 to the agitator driving gear 126 is maintained.

As shown in FIGS. 6 and 15, the gear cover 143 is attached to the side wall 141 so as to cover the gear mechanism 109, specifically, the input gear 120, intermediate gear 125, agitator driving gear 126, developing roller driving gear 131, and feed roller driving gear 140. The detecting gear 205 is covered with the gear cover 143 so that the detection projection 238 is exposed leftward.

The gear cover 143 unitarily includes a cover plate 230 arranged in opposed relation to the left-side side wall 141 so as to interpose the gear mechanism 109 in the width direction, and a foot portion 231 extending so as to bend toward the side wall 141 from the peripheral end portion of the cover plate 230.

As shown in FIG. 15, the cover plate 230 has a coupling insertion hole 232 as a hole for inserting the coupling gear 144 in an opposed position to the coupling gear 144 of the input gear 120. The coupling insertion hole 232 has a diameter larger than the coupling gear 144 but smaller than the inner teeth gear 149 to allow advance and retract of the coupling gear 144.

The peripheral portion of the coupling insertion hole 232 in the cover plate 230 has on its left side surface a cylindrical portion 233 expanded leftward. The widthwise length of the cylindrical portion 233 is about two-thirds of that of the coupling gear 144.

The cover plate 230 has a developing roller shaft insertion hole 234 in an opposed position to the developing roller shaft 45, and the developing roller shaft insertion hole 234 allows the left-side shaft end portion of the developing roller shaft 45 that penetrates the developing roller driving gear 131 to further protrude leftward from the gear cover 143.

The cover plate 230 has a cylinder 235 inserted into the support recess 229 in the intermediate gear 125.

As shown in FIG. 5, the side wall 141 has boss portions 237 that allow screwing of fixing screws 236 (see FIG. 6) and are provided below the feed roller driving gear 140 and obliquely above the rear side of the agitator driving gear 126, respectively. Each boss portion 237 protrudes leftward from the side wall 141.

As shown in FIG. 15, the gear cover 143 is attached to the side wall 141 by the following process: while the coupling gear 144, the developing roller shaft 45, and the cylinder 235 are inserted through the coupling insertion hole 232, through the developing roller shaft insertion hole 234, and into the support recess 229 of the intermediate gear 125, respectively, in the cover plate 230, the gear cover 143 is in opposed relation to the input gear 120, intermediate gear 125, agitator driving gear 126, developing roller driving gear 131, and feed roller driving gear 140 so as to cover them; and then, the distal end face (right end face) of the foot portion 231 is abutted against the side wall 141, and subsequently the fixing screws 236 is allowed to penetrate the cover plate 230 to screw into the boss portions 237 (see FIG. 5).

Thus, the input gear 120 is protected by the gear cover 143 while the coupling gear 144 protrudes outward in the width direction (leftward) from the coupling insertion hole 232, more specifically, the portion equivalent to about one-fourth of the widthwise length of the coupling gear 144 protrudes from the left end edge of the cylindrical portion 233, and the inner teeth gear 149 is covered with the cover plate 230.

The input gear 120 is normally urged in the advance direction (leftward, i.e., outward in the width direction) by the coil spring 225 interposed between the side wall 141 and the input gear 120. Thus, the outer peripheral portion of the left end face of the inner teeth gear 149 of the input gear 120 normally abuts against the peripheral portion of the coupling insertion hole 232 in the cover plate 230, thereby restricting further movement of the input gear 120 toward the advance direction. In this state, the input gear 120 is moved to the most advanced position in the advance direction, and can be coupled to the driving gear 110 described later.

On the other hand, when the input gear 120 is pressed rightwardly by resisting the urging force of the coil spring 225, the input gear 120 moves in the retract direction (rightward, i.e., inward in the width direction) to a retract position where only the left end face and the gear inclined surface 222 (see FIG. 19) of the coupling gear 144 are exposed toward the advance direction from the cylindrical portion 233, as shown in FIG. 16. The left end portion of the input gear 120 at the retract position, that is, the left end portion of the coupling gear 144 is arranged in a position to be flush with or the left side of the left end portion of the developing roller shaft 45.

The developing roller driving gear 131 and the feed roller driving gear 140 (not shown in FIGS. 15 through 18) are entirely meshed with the inner teeth gear 149 of the input gear 120 both at the advance position (see FIGS. 6 and 15) and at the retract position (see FIGS. 7 and 16), so that the meshing area between the inner teeth gear 149 of the input gear 120 and the developing roller driving gear 131, and that between the inner teeth gear 149 and the feed roller driving gear 140 do not change.

However, the outer teeth gear 228 of the intermediate gear 125 entirely meshes with the inner teeth gear 149 at the advance position (see FIG. 15), but only its substantially right half meshes therewith at the retract position (see FIG. 16). Therefore, the meshing area between the inner teeth 149 and the intermediate gear 125 becomes larger at the advance position than at the retract position. Accordingly, the total meshing area of the developing roller driving gear 131, feed roller driving gear 140 and intermediate gear 125 with respect to the input gear 120 becomes larger at the advance position than at the retract position.

The coupling gear 144 is relatively unrotatably coupled to the driving gear 110 provided in the main body casing 2 as described later. A driving force from the motor (not shown) provided in the main body casing 2 is transmitted to the driving gear 110.

As shown in FIG. 4, the developer frame 31 is provided with a developer cartridge grasp portion 146 which is formed in a thin plate shape longer in the left and right direction, and which is provided on an upper wall 147 of the developer frame 31.

The developer cartridge grasp portion 146 allows a rotating shaft (not shown) to insert through at its rear end portion along the left and right direction, and is swingably supported at the rear end portion of the upper wall 147 of the developer frame 31 via the rotating shaft (not shown).

As shown in FIG. 10, the developer cartridge grasp portion 146 has a grasp slot 209 generally in a rectangular shape as viewed in plane at its center of the left and right direction.

As shown in FIG. 5, the front end portion of the developer cartridge grasp portion 146 is coupled to the front end portion of the upper wall 147 at their both opposing end portions in the left and right direction by elastic members 210, such as a coil spring, a leaf spring, and a sponge, so that the front end portion of the developer cartridge grasp portion 146 is normally urged away from the front end portion of the upper wall 147.

The front end portion of the developer cartridge grasp portion 146 is provided at its both end portions in the width direction with a pressing projection 211 that protrudes outward in the width direction.

(2) Attachment/Detachment of Developer Cartridges to/from Drum Unit

Next, the attachment and detachment of the developer cartridge 22 to and from the drum unit 21 will be described in detail with reference to FIGS. 11 through 19.

(2-1) Attachment of Developer Cartridges to Drum Unit

When the developer cartridge 22 for each color is attached to the drum subunit 23 for each color of the drum unit 21, first, the developer cartridge 22 is attached to the corresponding drum subunit 23 from above the drum unit 21 as shown in FIGS. 11 and 15.

Specifically, the right-side collar member 50 (see FIG. 5) of the developing roller shaft 45 and the current supply cylindrical portion 90 (see FIG. 5) of the developer cartridge 22 are inserted into the right guide groove 73 (see FIG. 8) formed in the right side frame 71 of the corresponding drum subunit 23. At the same time, the left-side collar member 50 of the developing roller shaft 45, the input gear 120, and the cylindrical portion 233 are inserted in the left guide groove 189 of the corresponding drum subunit 23. Then, the developer cartridge 22 is pressed downward to the drum subunit 23 so that the right-side collar member 50 and the current supply cylindrical portion 90 slide downward along the right guide groove 73, and that the left-side collar member 50, the input gear 120, and the cylindrical portion 233 slide downward along the left guide groove 189. The attaching and detaching directions of the developer cartridge 22 to and from the drum subunit 23 are the up and down direction as mentioned above.

When the developer cartridge 22 is pressed downward to the drum subunit 23, the left end portion of the input gear 120 abuts against the guide side wall 166 in the left guide groove 189 of the drum subunit 23 and advances or retracts in the left and right direction.

Specifically, when attaching of the developer cartridge 22 to the drum subunit 23 is started, an urging force of the coil spring 225 presses the left end portion of the input gear 120 against the upper end portion of the guide side wall 166.

As described above, the guide side wall 166 is provided with the upper inclined portion 169 downwardly from its upper end portion, so that when the developer cartridge 22 is further pressed downward to the drum subunit 23, the input gear 120 is pressed against the upper inclined portion 169. Thus, against the urging force of the coil spring 225, the input gear 120 retracts in the retract direction which is inward of the width direction (rightward).

Then, at the lower end of the upper inclined portion 169, the input gear 120 is retracted to the aforementioned retract position.

As the developer cartridge 22 is further pressed downward to the drum subunit 23, as shown in FIGS. 12 and 16, the input gear 120 is pressed against the upper base 167 that is continuous with the lower portion of the upper inclined portion 169 in the guide side wall 166, and is kept in the retract position.

Subsequently, when the developer cartridge 22 is further pressed downward to the drum subunit 23, the input gear 120 is pressed against the lower inclined portion 170 that is continuous with the lower portion of the upper base 167 in the guide side wall 166. As described above, the lower inclined portion 170 is formed so as to incline leftward from top to bottom, so that the pressing force of the lower inclined portion 170 against the input gear 120 reduces as the input gear 120 moves downward. Thus, the urging force of the coil spring 225 moves the input gear 120 in the advance direction, outward in the width direction (leftward).

When the collar members 50 at the opposite axial end portions of the developing roller shaft 45 respectively abut against the deepest portions (see FIG. 8) in the right guide groove 73 and the left guide groove 189, the developer cartridge 22 is fully attached in the corresponding drum subunit 23.

At this time, the input gear 120 is in an advance position and positioned below the bottom recess 164 which is the lower end edge portion of the lower inclined portion 170 in the guide sidewall 166, as shown in FIGS. 13 and 17. Further, the input gear 120 is opposed in the width direction to the coupling inner insertion portion 74 formed in the left side frame 70, and to the coupling outer insertion hole 130 formed in the left-side side plate 121, so as to allow the driving gear 110 (see FIGS. 15 through 18) provided in the main body casing 2 to retractably pass through. In this state, the left end portion of the input gear 120 is positioned leftward of right end edge of the guide side wall 166, or of the upper base 167.

Each of the collar members 50 abuts against the groove walls of the deepest portion of the right guide groove 73 or the left guide groove 189. The groove walls are opposed to each other and define a groove width of the deepest portion. Then, each positioning projection 217 of the developer cartridge 22 abuts against the positioning roller 218 (see FIG. 8) of the drum subunit 23 and the positioning roller 218 (see FIG. 9) of the front beam 96. As shown in FIG. 2, the rubber roller 46 of the developing roller 34 of the developer cartridge 22 abuts against the surface of the photosensitive drum 24.

When the developer cartridge 22 is attached in the corresponding drum subunit 23, the aforementioned current supply cylindrical portion 90 (see FIG. 5) of the developer frame 31 abuts against the convex 176 (see FIG. 8) of the current supply coil 155 connected to the developing roller electrode 82 provided in the right side frame 71.

When the developer cartridge 22 is attached in the corresponding drum subunit 23, as shown in FIG. 6, the left-side window 142 embedded in the side wall 141 of the developer frame 31 is opposed in the width direction to the boss 75 formed on the left side frame 70 and to the light passing hole 123 formed in the left-side side plate 121 so that detection light can pass through. Further, as shown in FIG. 10, the right-side window 142 embedded in the side wall 141 of the developer frame 31 is opposed in the width direction to the boss 75 formed on the right side frame 71 and to the light passing hole 123 formed in the right-side side plate 121 so that detection light can pass through.

In this way, all the developer cartridges 22 are attached to the drum subunits 23, and thereafter, as shown in FIG. 1, when the drum unit 21 is attached in the drum accommodation section 161 of the main body casing 2, the image forming operation described above allows formation of a color image on the sheet 3.

(2-2) Detachment of Developer Cartridges from Drum Unit

When the developer cartridge 22 for each color is attached in the drum subunit 23 for each color in the drum unit 21, as shown in FIG. 10, it is possible to withdraw the developer cartridge 22 upwards by inserting a finger into the grasp slot 209 and holding the developer cartridge grasp portion 146, and then by lifting the developer cartridge 22 upwards.

When the developer cartridge 22 is raised upward from the drum subunit 23, as shown in FIGS. 13 and 17, first, each of the collar members 50 is spaced away from the groove walls in the deepest portion of the right guide groove 73 or the left guide groove 189. The groove walls are opposed to each other and define a groove width of the deepest portion. Each of the positioning projections 217 of the developer cartridge 22 is spaced away from the positioning roller 218 (see FIG. 8) of the drum subunit 23 and the positioning roller 218 (see FIG. 9) of the front beam 96. Further, the rubber roller 46 of the developing roller 34 of the developer cartridge 22 is spaced away from the surface of the photosensitive drum 24. Further, the aforementioned current supply cylindrical portion 90 (see FIG. 5) of the developer frame 31 is spaced away from the convex 176 (see FIG. 8) of the current supply coil 155 provided on the right side frame 71. Then, the right-side collar member 50 and the current supply cylindrical portion 90 (see FIG. 5) move upwards along the right guide groove 73, and the left-side collar member 50, the input gear 120, and the cylindrical portion 233 move upwards along the left guide groove 189.

The input gear 120 in the advance position is then no longer opposed in the width direction to the coupling inner insertion portion 74 nor the coupling outer insertion hole 130 of the left-side side plate 121, and is pressed against the lower inclined portion 170 of the guide side wall 166 in the bottom recess 164. When the developer cartridge 22 is further raised upward from the drum subunit 23, the input gear 120 is pressed by the lower inclined portion 170. Thus, against the urging force of the coil spring 225, the input gear 120 retracts in the retract direction which is inward of the width direction.

Then, at the upper end of the lower inclined portion 170, the input gear 120 is retracted to the aforementioned retract position.

When the developer cartridge 22 is further raised upward from the drum subunit 23, as shown in FIGS. 12 and 16, the input gear 120 is pressed against the upper base 167 that is continuous with the upper portion of the lower inclined portion 170 in the guide side wall 166, and is kept at the retract position.

Subsequently, when the developer cartridge 22 is further raised upward from the drum subunit 23, the input gear 120 is pressed against the upper inclined portion 169 that is continuous with the upper portion of the upper base 167 in the guide side wall 166. As described above, the upper inclined portion 169 is formed so as to incline leftward from bottom to top, so that the pressing force of the upper inclined portion 169 against the input gear 120 reduces as the input gear 120 moves upward. Then, the urging force of the coil spring 225 moves the input gear 120 in the advance direction which is outward in the width direction.

When the collar members 50 at the opposite axial end portions of the developing roller shaft 45 are respectively detached from the right guide groove 73 and the left guide groove 189, the developer cartridge 22 is completely detached from the corresponding drum subunit 23. At this time, as shown in FIGS. 11 and 15, the input gear 120 is in the advance position.

4. Main Body Casing

As shown in FIG. 1, the main body casing 2 has a box-like shape of a generally rectangle as viewed in side opened on the front side, and is provided in its inner portion with a drum accommodation section 161 that accommodates the drum unit 21. The front wall of the main body casing 2 has a drum mounting port 162 that allows communication with the drum accommodation section 161.

A front cover 163 for opening and closing the drum mounting port 162 is provided in the front wall of the main body casing 2. The front cover 163 is rotationally supported via hinges (not shown) provided at the lower end portion of the drum mounting port 162 of the main body casing 2, and is openable and closable with respect to the main body casing 2. Thus, when the front cover 163 is closed around the hinges as fulcrums, the drum mounting port 162 is closed by the front cover 163. On the contrary, when the front cover 163 is opened around the hinges as fulcrums, the drum mounting port 162 is opened, which allows the drum unit 21 to be attached to or detached from the drum accommodation section 161 on the front side through this drum mounting port 162.

The drum accommodation section 161 is provided with rollers (not shown) and rails. The rails (not shown) are respectively provided in the inner wall surfaces of the main body side walls 165 of the main body casing 2 so as to be opposed to each other in the width direction and extend anteroposteriorly. The rollers (not shown) are respectively rotatably provided on the inner wall surface of each main body side wall 165 so as to be slightly spaced apart from each rail above the front end portion of the rail.

Therefore, the flange portions 122 (see FIG. 9) of the side plates 121 are guided to the rollers (not shown), and the rollers 177 (see FIG. 9) are guided on the rails (not shown), so that the drum unit 21 is anteroposteriorly smoothly attached to or detached from the drum accommodation section 161.

The drum accommodation section 161 is provided at its rear end portion with a positioning bar (not shown) that is extended between the inner wall surfaces of the both main body side walls 165, and is provided with a positioning mechanism (not shown) at a position adjacent to the aforementioned roller (not shown) in its front end portion. The positioning mechanism (not shown) selectively applies pressing force rearward (in the attaching direction of the drum unit 21) or forward (in the detaching direction of the drum unit 21) with respect to the drum unit 21 accommodated in the drum accommodation section 161, in response to opening and closing of the front cover 163.

Specifically, when the drum unit 21 is accommodated in the drum accommodation section 161, and the front cover 163 is then closed, the positioning mechanism (not shown) presses the positioning shaft 204 (see FIG. 9) of the drum unit 21 rearwards. As a result, the notched portion 179 (see FIG. 9) of each side plate 121 described above is abutted against the positioning bar (not shown) of the drum accommodation section 161, whereby the positioning mechanism (not shown) and the positioning bar (not shown) position the drum unit 21 within the drum accommodation section 161.

On the contrary, when the front cover 163 is opened, the positioning mechanism (not shown) presses the positioning shaft 204 (see FIG. 9) of the drum unit 21 frontward. At this time, the notched portion 179 is spaced away from the positioning bar (not shown), thereby bringing the drum unit 21 out of positioning within the drum accommodation section 161. Therefore, the drum unit 21 can be detached from the drum accommodation section 161.

By grasping of the front-side grasp portion 104 (see FIG. 9) in the operation position described above, attachment/detachment of the drum unit 21 to/from the drum accommodation section 161 is performed. Rotational move of the front-side grasp portion 104 to the accommodation position allows closing of the front cover 163. The opening and closing of the front cover 163 may be in conjunction with the rotational move of the front-side grasp portion 104.

The main body casing 2 has a tray accommodation section 171 for accommodating the sheet feeding tray 7, below the drum accommodation section 161. The main body casing 2 is also provided at its front wall with a tray mounting port 172 that communicates with the tray accommodation section 171.

The aforementioned sheet feeding tray 7 is anteroposteriorly slidably attached to the tray accommodation section 171, so that the sheet feeding tray 7 in the state of being attached in the tray accommodation section 171 can be detached from the tray accommodation section 171 by drawing the sheet feeding tray 7 toward the front.

As shown in FIGS. 15 through 18, the left-side main body side wall 165 includes an outer side wall 192 that defines an outer (left side) surface in the width direction, and an inner side wall 193 that defines an inner (right side) surface in the width direction.

Between the outer side wall 192 and the inner side wall 193 in the width direction, the driving gear 110 that is retractably coupled to the input gear 120 of the developer cartridge 22 in the width direction and an arm 194 for advancing or retracting the driving gear 110 in the width direction (in the left and right direction), are provided.

As shown in FIGS. 14(*a*) and 14(*b*), the arm 194 unitarily includes an arm portion 195 extending anteroposteriorly and a cam portion 196 provided at the rear end portion of the arm portion 195.

The cam portion 196 is provided with a slit 197 anteroposteriorly extending for allowing insertion of the driving gear 110. The slit 197 has around its rear end portion a retract portion 198 formed thick in the width direction, and around its front end portion an advance portion 199 formed thin in the width direction.

This arm 194 is supported so as to be anteroposteriorly movable along the inner side wall 193, in the state where the driving gear 110 is inserted through the slit 197 provided in its rear end portion. The arm 194 moves anteroposteriorly in conjunction with opening and closing of the front cover 163. For convenience of explanation, in FIGS. 15 through 18, the moving direction of the arm 194 is the up and down direction.

As shown in FIGS. 15 through 18, the driving gear 110 is arranged in opposed relation in the width direction to the input gear 120 of the drum unit 21 that has been attached in the main body casing 2. An urging spring 242 urges the driving gear 110 normally inward (leftward) in the width direction, specifically, toward the coupling insertion hole 187.

During the attachment/detachment of the drum unit 21 to/from the main body casing 2, when the front cover 163 (see FIG. 1) is opened, the arm 194 moves downward (forward in FIGS. 14(*a*) and 14(*b*)) in conjunction with the opening of the front cover 163, and, as shown in FIG. 17, the retract portion 198 comes into engagement with the driving gear 110. Then, against the urging force of the urging spring 242, the driving gear 110 retracts from the coupling insertion hole 187 of the coupling gear 144 to the left side (outward in the width direction) in the rotational axial direction of the driving gear 110 (in the width direction, i.e., in the left and right direction).

After attaching of the drum unit 21 to the main body casing 2, by closing the front cover 163, the arm 194 moves upward (rearward in FIGS. 14(*a*) and 14(*b*)) in conjunction with the closing of the front cover 163, and as shown in FIG. 18, the advance portion 199 comes into engagement with the driving gear 110. Then, due to the urging force of the urging spring 242, the driving gear 110 advances rightward (inward in the width direction), toward the inside of the coupling insertion hole 187 of the coupling gear 144 of the input gear 120, so that the driving gear 110 is relatively unrotatably coupled thereto.

Thus, in each developer cartridge 22, the driving force from the motor (not shown) is transmitted from the driving gear 110 to the input gear 120, so that the agitator 32, feed roller 33, developing roller 34, and detecting gear 205 are rotationally driven.

As shown in FIG. 8, the terminals connected to the high-voltage circuit board (not shown) provided in the main body casing 2, are respectively connected to the wire electrodes 80 and the grid electrodes 81 that are exposed from the respective center openings 133 formed in the right-side side plate 121, the developing roller electrodes 82 exposed from the respective front openings 134, and further the cleaning electrodes 83 exposed from the respective rear openings 135.

5. Operations and Effects

As described above, in this color laser printer 1, the input gear 120 of the developer cartridge 22 can move between the advance and the retract positions, and is normally urged in the advance direction of moving toward the guide side wall 166 of the drum subunit 23, that is, leftward.

Between the upstream end (upper end portion) and the downstream end portion (lower end portion) in the attaching direction (up and down direction) of the developer cartridge 22 to the drum subunit 23, the guide side wall 166 protrudes rightward of these upper and lower end portions. Specifically, the guide side wall 166 includes the lower inclined portion 170 above the downstream end portion described above, and the upper inclined portion 169 above the lower inclined portion 170 but below the upstream end portion described above. The upper inclined portion 169 and the lower inclined portion 170 incline rightwardly (the retract direction of the input gear 120) and leftwardly (the advance direction of the input gear 120), respectively, from top to bottom.

Therefore, the input gear 120 is in the advance position in an opposed state to the aforementioned upstream end portion of the guide side wall 166, and retracts in an opposed state to the upper inclined portion 169 and the lower inclined portion 170 after the start of attaching of the developer cartridge 22 to the drum subunit 23. In the state where the developer cartridge 22 is attached in the drum subunit 23, the input gear 120 is in an advance position, and its downstream end portion in the advance direction, that is, its left end portion, is arranged leftward of the right-side end of the guide side wall 166, or the upper base 167.

Thus, when the developer cartridge 22 is completely attached in the drum subunit 23, the urging force of the coil spring 225 for urging the input gear 120 arranges the left end portion of the input gear 120 in an advance position leftward of the right end of the guide side wall 166. In this state, when the developer cartridge 22 is attempted to move away from the drum subunit 23 for detachment, the guide side wall 166 interferes with the input gear 120. Specifically, the left end portion of the input gear 120 is interfered with the lower inclined portion 170 of the guide side wall 166, whereby movement of the developer cartridge 22 is regulated. Thus, the developer cartridge 22 is retained in the drum subunit 23.

As a result, the developer cartridge 22 can be easily and securely retained by the drum subunit 23. Such retaining as well as attaching of the developer cartridge 22 to the drum subunit 23 can improve operability of the color laser printer 1 including the developer cartridge 22 and the drum subunit 23. Further, it is possible to add the aforementioned function of retaining the developer cartridge 22 by the drum subunit 23 to the input gear 120 is coupled to the driving gear 110 to rotate the developing roller 34. This eliminates the necessity of providing a dedicated component for retaining the developer cartridge 22 by the drum subunit 23, which can simplify the construction of the apparatus.

The guide side wall 166 is arranged in the left guide groove 189 defined by the left side frame 70 and the left side plate 95 of the drum subunit 23. The left guide groove 189 is for guiding the input gear 120 during the attachment/detachment of the developer cartridge 22 to/from the drum subunit 23, and allows guiding of the input gear 120 as well as retaining of the developer cartridge 22 by the drum subunit 23 during the attaching. Thus, the operability of the color laser printer 1 can be improved.

The guide side wall 166 is provided with the coupling inner insertion portion 74 that is opposed to the input gear 120 and the driving gear 110 in the advance direction (width direction) described above in the state where the developer cartridge 22 is attached in the drum subunit 23. In this attached state, the input gear 120 and the driving gear 110 can be coupled to each other through the coupling inner insertion portion 74. The coupling inner insertion portion 74 has a size capable of inserting through the driving gear 110, so that in the state where the developer cartridge 22 is attached in the drum subunit 23, the input gear 120 is able to couple to the driving gear 110 through the coupling inner insertion portion 74 while keeping a non-contact state with the guide side wall 166. Thus, the driving force from the driving gear 110 can be fully transmitted to the input gear 120.

In addition, by moving the input gear 120 to a retract position, the retention of the developer cartridge 22 by the drum subunit 23 and the coupling of the input gear 120 to the driving gear 110 can be reliably released. As described above, the lower inclined portion 170 is formed so as to incline rightwardly from bottom to top, so that when the developer cartridge 22 is detached from the drum subunit 23, the input gear 120 can be smoothly retracted by the lower inclined portion 170, thereby smoothly releasing the retention of the developer cartridge 22 by the drum subunit 23.

Since the gear cover 143 can restrict the movement of the input gear 120 in the advance direction, the advance amount of the input gear 120 required to retain the developer cartridge 22 by the drum subunit 23 as well as to couple to the driving gear 110 can be set for the input gear 120 using a simple mechanism.

Since the gear cover 143 has the coupling insertion hole 232, the input gear 120 can advance/retract at the coupling insertion hole 232, and the portions of the gear cover 143 other than the input gear 120 protect the input gear 120. Therefore, the gear cover 143 is capable of protecting the developing roller driving gear 131, while allowing the advance/retract of the input gear 120.

The gear cover 143 serves not only to protect the developing roller driving gear 131, but also to regulate the advance amount of the input gear 120. This eliminates the necessity of providing a particular member for restricting the advance amount of the input gear 120, which can reduce the number of component parts.

When the developer cartridge 22 is attached to the drum subunit 23, the input gear 120 can be accurately guided in the advance/retract direction described above by the input gear support shaft 148. Therefore, upon the completion of the attaching, the developer cartridge 22 can be securely retained by the drum subunit 23, and the input gear 120 and the driving gear 110 can be securely coupled to each other. Further, the input gear support shaft 148 guides the input gear 120 in the advance/retract direction, which can reduce the number of component parts.

In addition, by providing the coil spring 225 along the input gear support shaft 148, the input gear 120 is urged so as to ensure that the left end portion of the input gear 120 is arranged leftward of the right end of the guide side wall 166, and so as to stably advance toward the driving gear 110, in the state where the developer cartridge 22 is attached in the drum subunit 23.

The input gear 120 includes the coupling gear 144 and the inner teeth gear 149, is coupled to the driving gear 110 by the coupling gear 144, and at the same time, meshes with the developing roller driving gear 131 by the inner teeth gear 149. Therefore, a driving force can be reliably and efficiently transmitted from the driving gear 110 to the developing roller driving gear 131 via the input gear 120.

The input gear 120 can always mesh with the developing roller driving gear 131 in the retractable range described above, thus allows the driving force of the driving gear 110 to be reliably transmitted to the developing roller driving gear 131 in the state where it is coupled to the driving gear 110.

The meshing area of the input gear 120 with the intermediate gear 125, developing roller driving gear 131, and feed roller driving gear 140 is larger when the input gear 120 is at an advance position without coupling to the driving gear 110 than when the input gear 120 is at a retract position without coupling thereto. Therefore, the driving force of the driving gear 110 can be stably transmitted to the input gear 120.

The coupling gear 144 of the input gear 120 has the gear inclined surface 222 formed by cutting its left end face. This surface can reduce the frictional force generated by contact between the left end portion of the coupling gear 144 and the guide side wall 166 of the drum subunit 23 when the developer cartridge 22 is attached to or detached from the drum subunit 23. Thus, the retention of the developer cartridge 22 by the drum subunit 23 and the release of the retention can be smoothly performed. The gear inclined surface 222 can also reduce the frictional force generated by contact between the left end portion of the coupling gear 144 and the main body side wall 165 of the main body casing 2 when the developer cartridge 22 is attached to or detached from the main body casing 2. Thus, the coupling of the input gear 120 to the driving gear 110 and the release of the coupling can be smoothly performed.

The developing roller 34 is arranged on the downstream side in the direction of attaching the developer cartridge 22 to the drum subunit 23, that is, the lower side, with respect to the input gear 120. The developing roller shaft 45 of the developing roller 34 and the input gear 120 are arranged so as to be at least partially overlapped with each other when projected in the attaching direction, for example, from below. The left end portion of the input gear 120 at the retract position is arranged in a position to be flush with or leftward of the left end portion of the developing roller shaft 45.

Therefore, when the developer cartridge 22 is attached to the drum subunit 23, the left end portion of the developing roller shaft 45 can be brought close to the guide side wall 166 before the input gear 120, so that the developer cartridge 22 can previously roughly be positioned with respect to the drum subunit 23 in the advance direction (width direction). The developing roller shaft 45 interferes with the guide side wall 166, and the developer cartridge 22 can be smoothly attached to the drum subunit 23.

Thus, following the developing roller shaft 45, the input gear 120 can be accurately opposed to the guide side wall 166, which in turn ensures the retention of the developer cartridge 22 by the drum subunit 23 in the attached state of the developer cartridge 22 to the drum subunit 23.

The color laser printer 1 includes a plurality of drum subunits 23 for the corresponding colors. These drum subunits 23 are as a drum unit 21 unitarily slidably attached in the main body casing 2, and are detached from the main body casing 2 by withdrawal.

As a result, the color laser printer 1 is capable of image formation with multiple colors while easily and securely retaining each developer cartridge 22 in the corresponding drum subunits 23, resulting in improvement in operability.

Second Embodiment

The first embodiment mentioned above shows as an example the color laser printer 1 of a tandem type for directly transferring toner images onto a sheet 3 from each photosensitive drum 24. However, the present invention is not limited thereto, and can be constituted, for example, as a color laser printer of an intermediate transfer type in which toner images for respective colors are once transferred to an intermediate transfer body from respective photosensitive members, and thereafter, transferred onto a sheet by one operation. Furthermore, the printer can be constituted as a monochrome laser printer. The monochrome laser printer may include a process unit as an image forming unit in which a single developer cartridge 22 is attached in a single drum subunit 23.

In the above explanation, two independent embodiments of the first and the second to which the present invention is applied, have been explained in detail. However, it is possible for those skilled in the art to optionally combine the aspects included in the two embodiments, thereby providing a developer cartridge, an image carrier unit and an image forming apparatus having the advantages described above with respect to the two embodiments.

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. A developer cartridge detachably attachable to a casing of an image carrier unit detachably attachable to an image forming apparatus body, the developer cartridge including:

a developing roller; and a first rotation body that rotates the developing roller by coupling to a second rotation body provided in the image forming apparatus body, in a state where the developer cartridge is attached in the casing, wherein the first rotation body is configured to advance and retract with respect to a side wall of the casing which extends along an attachment/detachment direction of the developer cartridge, and is normally urged in an advance direction, and a downstream end portion of the first rotation body in the advance direction is arranged downstream in the advance direction from an upstream end of the side wall in the advance direction, in the state where the developer cartridge is attached in the casing.

2. The developer cartridge according to claim 1, including:

a restricting member that restricts movement of the first rotation body in the advance direction; and an urging member that urges the first rotation body in the advance direction against the restricting member.

3. The developer cartridge according to claim 2, including a guide member that guides movement of the first rotation body in an advance/retract direction.

4. The developer cartridge according to claim 3, wherein the guide member is a shaft that supports the first rotation body.

5. The developer cartridge according to claim 4, wherein the urging member is a coil spring provided along the shaft.

6. The developer cartridge according to claim 2, including a third rotation body that is meshed with the first rotation body and transmits the driving force from the first rotation body to the developing roller, wherein the restricting member is a cover member that protects the third rotation body.

7. The developer cartridge according to claim 6, wherein a hole allowing the first rotation body to advance and retract is formed in the restricting member.

8. The developer cartridge according to claim 6, wherein the first rotation body can always be meshed with the third rotation body in a range in which the first rotation body advances and retracts.

9. The developer cartridge according to claim 2, wherein the first rotation body is movable to an advance position and a retract position, the advance position is a position where the first rotation body can be coupled to the second rotation body by advancing to a most downstream position in the advance direction, and where the downstream end portion of the first rotation body in the advance direction is arranged downstream in the advance direction from an upstream end of the side wall in the advance direction, and the retract position is a position where the first rotation body is retracted from the advance position to an upstream position in the advance direction so that only the downstream end portion of the first rotation body in the advance direction is exposed in the advance direction from the restricting member.

10. The developer cartridge according to claim 9, wherein the developing roller is arranged downstream in a attaching direction of the developer cartridge to the casing, with respect to the first rotation body, the developing roller and the first rotation body are arranged so as to be at least partially overlapped with each other when projected from the attaching direction, and at the retract position, the downstream end portion of the first rotation body in the advance direction is arranged in a position to be flush with a downstream end portion of the developing roller in the advance direction, or on a downstream position in the advance direction with respect to the developing roller.

11. The developer cartridge according to claim 9, including a meshing member including a third rotation body that is meshed with the first rotation body and transmits the driving force from the first rotation body to the developing roller, wherein a meshing area between the first rotation body and the meshing member is larger when the first rotation body is at the advance position than at the retract position.

12. The developer cartridge according to claim 1, including a third rotation body that is meshed with the first rotation body and transmits the driving force from the first rotation body to the developing roller, wherein the first rotation body includes a coupling portion that is coupled to the second rotation body, and a meshing portion that meshes with the third rotation body.

13. The developer cartridge according to claim 12, wherein the coupling portion has an inclined surface formed by cutting off a edge in the advance direction to guide movement of the first rotation body in an advance/retract direction.

14. An image carrier unit detachably attachable to an image forming apparatus body, including:

a casing; and a developer cartridge detachably attachable to the casing, wherein the developer cartridge includes a developing roller, and a first rotation body that rotates the developing roller by coupling to a second rotation body provided in the image forming apparatus body in a state where the developer cartridge is attached in the casing, the first rotation body is configured to advance and retract with respect to a side wall of the casing which extends along an attachment/detachment direction of the developer cartridge with respect to the casing, and is normally urged in an advance direction, a downstream end portion of the first rotation body in the advance direction is arranged downstream in the advance direction from an upstream end of the side wall in the advance direction, in the state where the developer cartridge is attached in the casing, the side wall is opposed to the first rotation body in the advance direction when the developer cartridge is attached to and detached from the casing, and the side wall is formed such that a portion thereof between upstream and downstream end portions in a attaching direction of the developer cartridge to the casing protrudes toward an upstream side in the advance direction from the upstream and downstream end portions.

15. The image carrier unit according to claim 14, wherein the side wall includes:

a first wall portion arranged upstream in the attaching direction and the advance direction, with respect to the downstream end portion; and a second wall portion arranged upstream in the attaching direction with respect to the first wall portion, arranged downstream in the attaching direction and upstream in the advance direction with respect to upstream end portion, inclining downstream in the advance direction from downstream to upstream in the attaching direction.

16. The image carrier unit according to claim 15, wherein the first wall portion inclines upstream in the advance direction from downstream to upstream in the attaching direction.

17. The image carrier unit according to claim 14, wherein an opening portion is formed in the side wall at a position where the side wall is opposed to the first rotation body and the second rotation body in the advance direction in the state where the developer cartridge is attached in the casing.

18. The image carrier unit according to claim 17, wherein the opening portion has a size capable of inserting the second rotation body therethrough, and in the state where the developer cartridge is attached in the casing, the first rotation body is in non-contact with the side wall.

19. The image carrier unit according to claim 14, wherein the casing includes a guide wall formed with a guide groove for guiding the first rotation body, when the developer cartridge is attached to and detached from the casing, and the side wall is arranged in the guide groove.

20. An image forming apparatus including:

an image forming apparatus body, an image carrier unit detachably attachable to the image forming apparatus body, a scanning section for forming an electrostatic latent image in the image carrier unit; and a fixing unit for fixing to a recording medium a developer image formed by developing the electrostatic latent image in the image carrier unit, wherein the image carrier unit includes a casing, and a developer cartridge detachably attachable to the casing, the developer cartridge includes a developing roller, and a first rotation body that rotates the developing roller by coupling to a second rotation body provided in the image forming apparatus body, in a state where the developer cartridge is attached in the casing, the first rotation body is configured to advance and retract with respect to a side wall of the casing which extends along an attachment/detachment direction of the developer cartridge with respect to the casing, and is normally urged in an advance direction, a downstream end portion of the first rotation body in the advance direction is arranged downstream in the advance direction from an upstream end of the side wall in the advance direction, in the state where the developer cartridge is attached in the casing, the side wall is opposed to the first rotation body in the advance direction when the developer cartridge is attached to and detached from the casing, and the side wall is formed such that a portion thereof between upstream and downstream end portions in the attaching direction of the developer cartridge to the casing protrudes toward an upstream side in the advance direction from the upstream and downstream end portions.

21. The image forming apparatus according to claim 20, including a plurality of the image carrier units corresponding to respective colors, wherein the plurality of image carrier units are together slidably attached to and detached from the image forming apparatus body.

* * * * *